US005474422A

United States Patent [19]

Sullivan

[11] Patent Number: 5,474,422

[45] Date of Patent: Dec. 12, 1995

[54] VOLUTE HOUSING FOR A CENTRIFUGAL FAN, BLOWER OR THE LIKE

[76] Inventor: John T. Sullivan, 3910 Madison St., Hyattsville, Md. 20781

[21] Appl. No.: 977,511

[22] Filed: May 19, 1992

Related U.S. Application Data

[63] Continuation-in-part of Ser. No. 642,768, Jan. 18, 1991, Pat. No. 5,141,397.

[51] Int. Cl.[6] ..... F04D 29/42

[52] U.S. Cl. ..... 415/206; 415/182.1

[58] Field of Search ..... 415/182.1, 206, 415/203, 204

[56] References Cited

U.S. PATENT DOCUMENTS

| | | | |
|---|---|---|---|
| 3,856,431 | 12/1974 | Tucker | 415/206 |
| 5,069,599 | 12/1991 | Carretta | 415/182.1 |
| 5,141,397 | 8/1992 | Sullivan | 415/206 |
| 5,156,524 | 10/1992 | Forni | 415/206 |
| 5,257,904 | 11/1993 | Sullivan | 415/206 |
| 5,281,092 | 1/1994 | Sullivan | 415/206 |

FOREIGN PATENT DOCUMENTS

| | | | |
|---|---|---|---|
| 145497 | 7/1985 | Japan | 415/206 |

*Primary Examiner*—John T. Kwon

*Attorney, Agent, or Firm*—Diller, Ramik & Wight

[57] ABSTRACT

A volute housing is provided for a centrifugal fan, blower or the like which includes a housing body defined by opposite spaced walls, and in another embodiment of the invention, the opposite spaced walls are snap-secured to a central wall. The sidewalls are defined by radially innermost, medial and radially outermost sidewall portions with the innermost sidewall portions being of a generally concave configuration and the radially outermost sidewall portions extending generally 180°. The radially outermost sidewall portions and the medial sidewall portions have a minimum radius and an axial length respectively at a first zone adjacent a tongue of an associate volute chamber while the radially outermost sidewall portions and the medial sidewall portions have a maximum radius and an axial length respectively at a second zone adjacent a throat of the volute chamber. The minimum radius and axial length each progressively increase from the first zone to the second zone with the arcuate distance therebetween approaching generally 360° but being preferably substantially 350°.

14 Claims, 14 Drawing Sheets

VOLUTE HOUSING FOR A CENTRIFUGAL FAN, BLOWER OR THE LIKE

CROSS-REFERENCE TO RELATED APPLICATION

This application is a continuation-in-part application of U.S. Pat. application Ser. No. 07/642,768 filed Jan. 18, 1991 in the name of John T. Sullivan, entitled A Volute Housing for cenrifugal Fan, Blower or the Like, and now U.S. Pat. No. 5,141,397.

BACKGROUND OF THE INVENTION

This invention is directed to a volute housing for a centrifugal fan, blower or the like. The theory, design and application of such centrifugal fans can be found in the publications entitled "Turboblowers" by Alexey Joakim Stepanoff, published by John Wiley & Sons, Inc. and available at the Library of the University of Maryland, College Park, Md. and "Fan Engineering" by Richard D. Madison, published by Buffalo Forge Company, Buffalo, N.Y. (copyright 1949) and also available at the latter noted library. These publications describe several volute housing designs, including a constant velocity volute which is said to be the most favorable for efficiency because of the alleged fact that at the best efficiency point pressure is uniform around the volute. The latter condition is said to be the most desirable for impeller performance. In this design the entire recovery of the kinetic energy into pressure takes place in the volute nozzle which is preferably of a diverging relationship with the included angle being established experimentally at 8° for a circular cone to obtain the most efficient velocity convergent through the nozzle, though a range of 6° to 10° is acceptable. Beyond 10° efficiency is adversely affected. However, in such constant velocity volute housings, the volute pressure is constant until released by the discharge nozzle. The disadvantage of such constant velocity volute housings is that the capacity must be maintained at all times at its rated capacity, otherwise at partial capacities, pressure increases toward larger volute sections and decreases toward smaller volute sections. This decreases efficiency and increases noise.

In an abbreviated volute housing about one-quarter of the impeller periphery discharges directly into the discharge opening without establishing normal volute pressure and velocity distribution prevailing in the remaining three-quarters of the controlled volute housing section. The disadvantage is that the average volute velocity may only be one-half of the absolute velocity at the impeller discharge. Thus sound is decreased but so too is efficiency.

In both the normal volute casing and the abbreviated volute casing, the sidewalls are substantially parallel to each other throughout and it is the peripheral volute wall which progressively diverges from the circular fluid inlet openings in a direction away from the cut-off point or tongue to the volute throat. Essentially, the volute peripheral wall ends at the volute throat and the volute throat defines the initiation or entrance of the discharge nozzle. It is in the area downstream of the throat that the discharge nozzle sidewalls are flared in a direction diverging away from each other in the direction of fluid travel. Such flaring can extend slightly downstream of the volute throat. Such volute casings or housings are generally constructed from galvanized metal and the divergent sidewall angles are extremely abrupt (20°–45°) resulting in excessive turbulence and swirling of discharge fluid/air with an attendant increase in noise.

Another volute housing includes typical circular fluid inlet openings, a volute peripheral wall and sidewalls which continuously diverge from the cut-off point or tongue in the direction of fluid flow to the throat and beyond the discharge nozzle to the discharge opening or orifice. A volute housing so constructed is found in U.S. Pat. No. 3, 491,550 in the name of Thomas C. Cavis issued Jan. 27, 1970. This construction increases the RPM's only, and effects expansion from the throat or cut-off point through 360° which basically creates a sound amplification structure typical of the curvature found in a tuba or a french horn. This creates a low bass hum which amplifies the highest sound at the compression point or tongue which is the area of maximum (and virtually only) compression.

From the foregoing, each of the volute housings known suffer from two main disadvantages, namely, (a) low efficiency and (b) high noise.

SUMMARY OF THE INVENTION

In keeping with the foregoing, a primary object of the present invention is to provide a novel volute housing which is (a) highly efficient and (b) quiet.

The novel volute housing of the present invention includes a housing body defined by opposite spaced sidewalls, a generally circular fluid inlet opening in each sidewall with the fluid inlet openings having a coincident axis and a volute peripheral wall disposed between the sidewalls. The sidewalls each have a generally minimum radial dimension located at a first zone (throat/cut-off area) which progressively increases to a maximum radial dimension located at a second zone (volute throat). The arcuate distance between these first and second zones is generally 360°, and to this extent the volute housing just described constitutes a normal volute housing. However, in keeping with this invention the sidewalls each have first and second sidewall portions with a first sidewall portion of each sidewall extending arcuately from the first zone (cut-off point/tongue) generally 180° to a transition zone, and over this arcuate extent the first sidewall portions are generally parallel to each other. The sidewalls also have second sidewall portions which extend arcuately from the transition zone to the volute throat, and in keeping with the invention, the second sidewall portions are in diverging relationship in a direction away from the transition zone to the volute throat whereby fluid flowing through the housing body in a direction from the transition zone toward the throat expands progressively axially outwardly as it flows between and along the second sidewall portions. This construction increases the efficiency of the volute housing and appreciably lessens sound/noise.

In further accordance with the present invention the housing body is preferably constructed from a pair of housing parts joined to each other along a radial plane generally normal to the coincident axis and between the sidewalls. Thus, the two housing parts can be rapidly interconnected to each other, preferably by cooperative male and female fasteners.

In further accordance with the present invention, another housing body is provided which is defined by opposite spaced sidewalls, each of which includes a radially innermost sidewall portion, a medial sidewall portion and a radially outermost sidewall portion, a medial sidewall portion and a radially outermost sidewall portion. The radially outermost sidewall portions are each of a generally concavely curved configuration extending approximately 180°, and each opens generally axially inwardly. Each radially outermost sidewall portion and each medial sidewall portion has a minimum radius and an axial length respectively at a first zone adjacent a tongue of the volute chamber which progressively increases to a maximum radius and a maximum axial length respectively at a second zone adjacent a throat of the volute chamber. The distance between the first and second zone approaches 360° whereby eddy currents are minimized during operation, total cfm is increased and both turbulence and noise levels are decreased.

Another volute housing is also provided in accordance with this invention which includes a volute peripheral wall and opposite sidewalls each of which only includes a radially outermost sidewall portion and a radially innermost sidewall portion with the radially outermost sidewall portion being of a generally concavely curved configuration extending approximately 180° and opening generally radially outwardly toward the outer volute peripheral wall. The latter configuration which avoids the medial wall portion earlier described further reduces eddy currents, turbulence and noise and increases total cfm.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
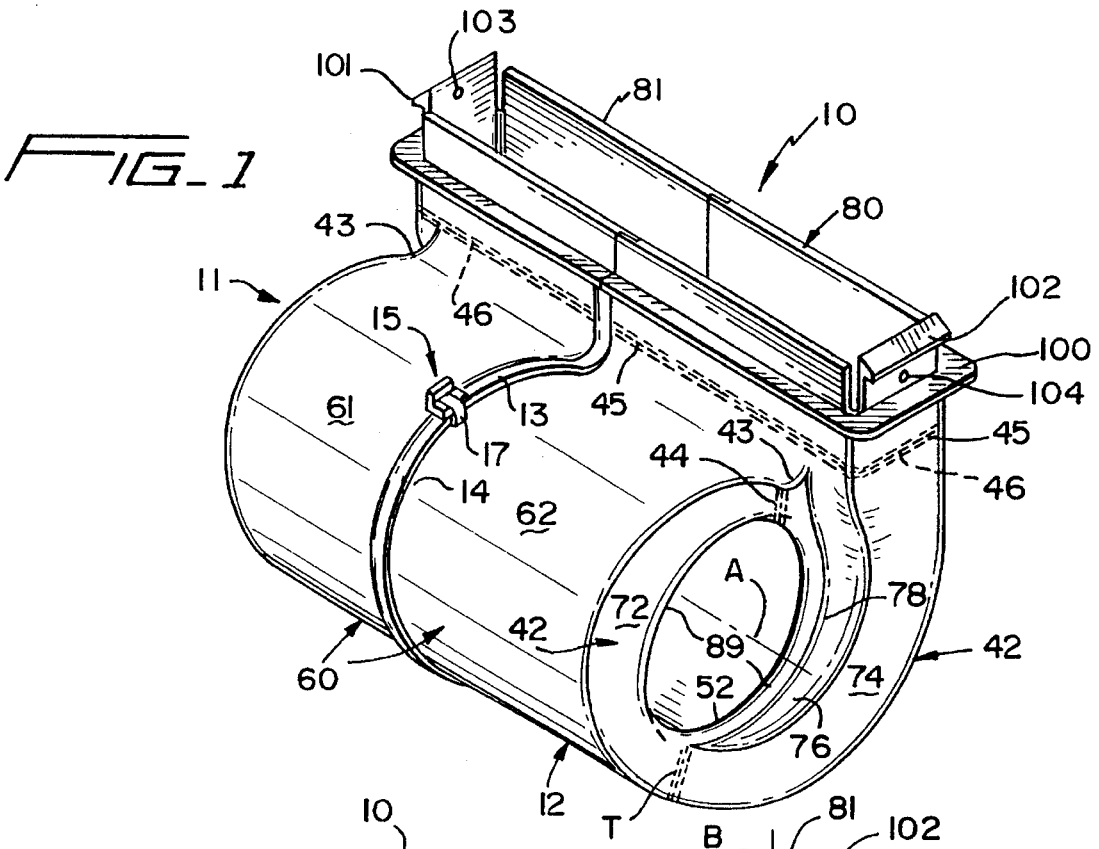
FIG. 1 is a perspective view of a novel volute housing constructed in accordance with this invention particularly adapted for utilization with a centrifugal fan, blower or the like, and illustrates a volute peripheral wall, a pair of sidewalls associated therewith, circular fluid inlet openings associated with each sidewall, and a sidewall portion which diverges progressively axially outwardly and in the direction of fluid flow between a transition zone (180°) and a volute throat (generally 360°).

A volute housing for a centrifugal fan, blower or the like is best illustrated in FIGS. 1–5 of the drawings and is generally designated by the reference numeral 10.

The volute housing 10 includes a housing body defined by a pair of housing parts or halves 11, 12. The housing parts 11, 12 are joined to each other along a generally radial plane R (FIGS. 3 through 5) through interlocked edges 13, 14 (FIGS. 3 and 4).

Figure 4:
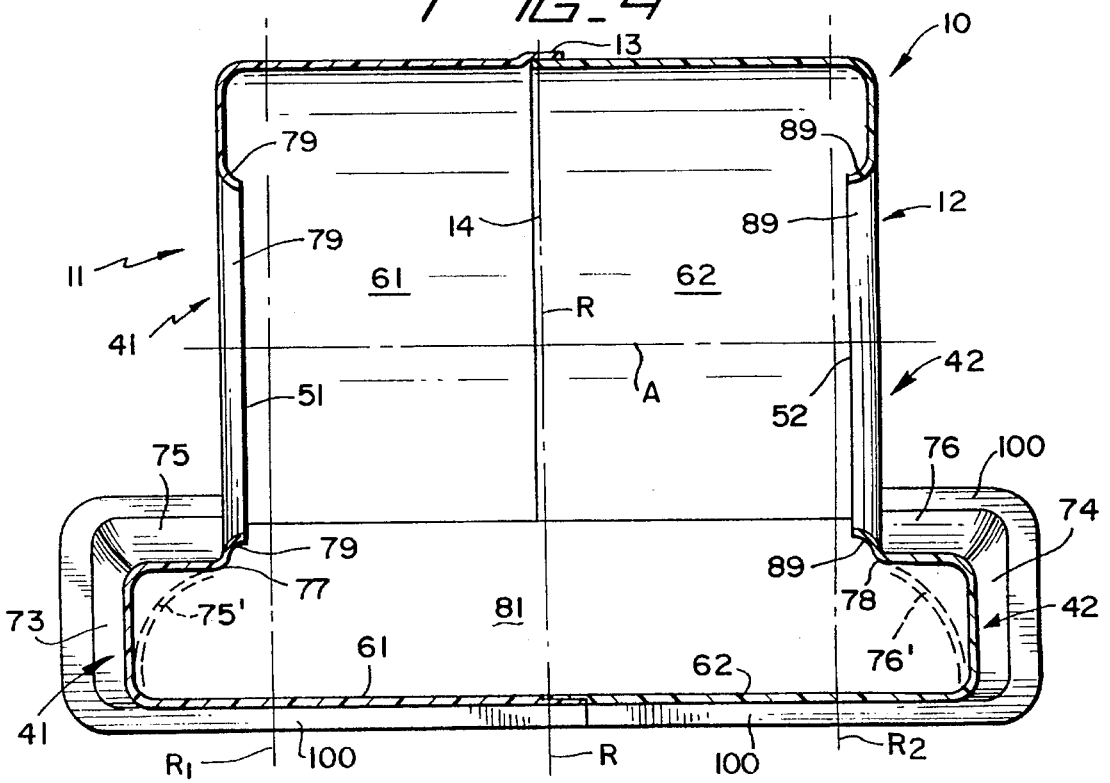
FIG. 4 is an enlarged cross sectional view taken generally along line 4—4 of FIG. 2, and illustrates the manner in which the sidewall portions of the volute housing body between approximately 180° and 360° diverge in a direction away from each other relative to the direction of fluid travel and toward the discharge nozzle opening.
Figures 5, 6:
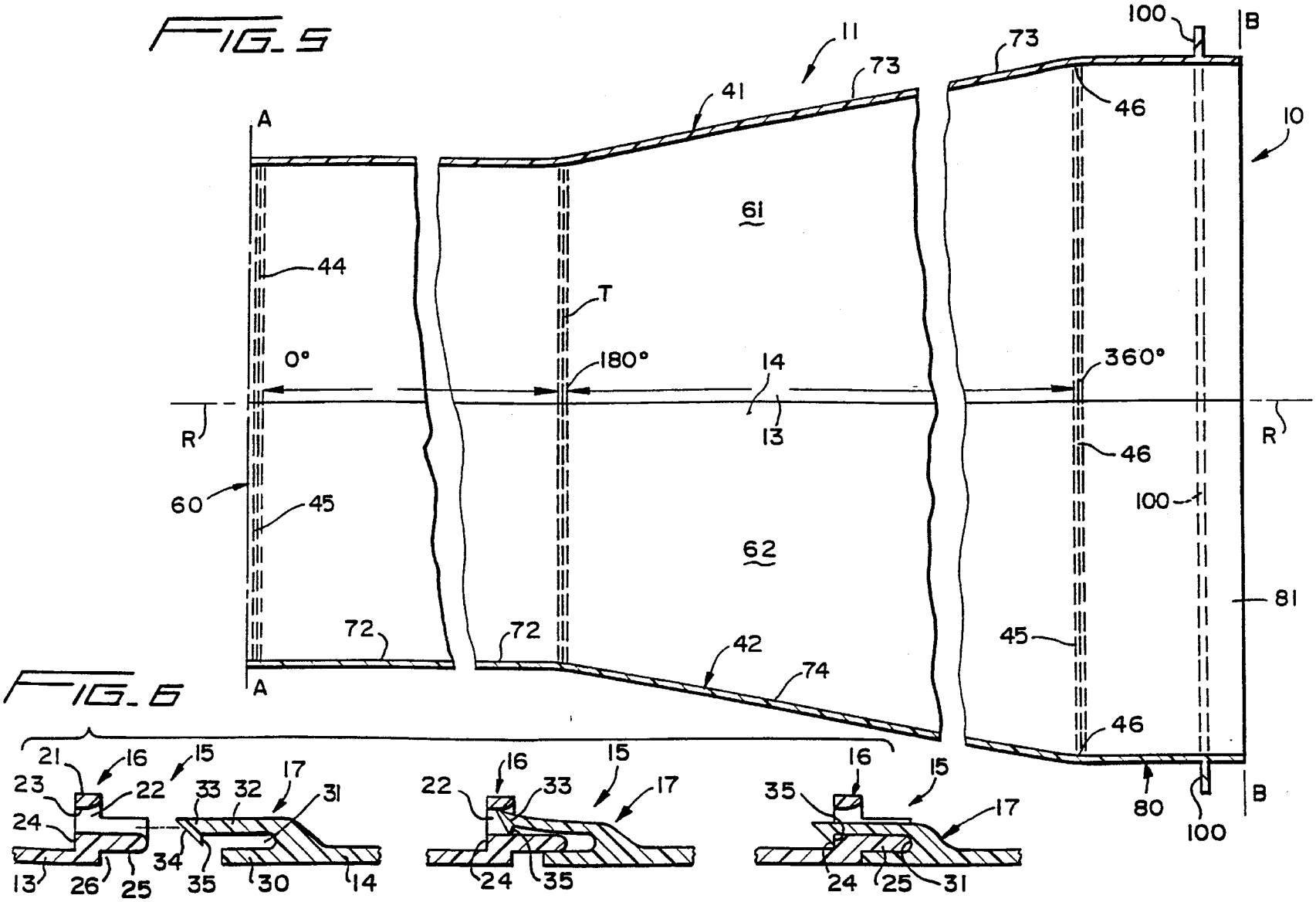
FIG. 5 is a cross sectional view taken generally along the line A–B of FIG. 2 and laid out in a flat plane, and illustrates the generally parallel relationship of a first pair of sidewall portions between a tongue or cut-off point (0°) and a transition zone 180° removed, and the divergent relationship of a pair of second sidewall portions between the transition zone (180°) and another zone (throat) 360° from the cut-off point/tongue.
FIG. 6 is an exploded fragmentary cross sectional view of one of several pairs of male and female fasteners, and illustrates the progressive sequence for snap-securing the same to each other.
Figure 7:
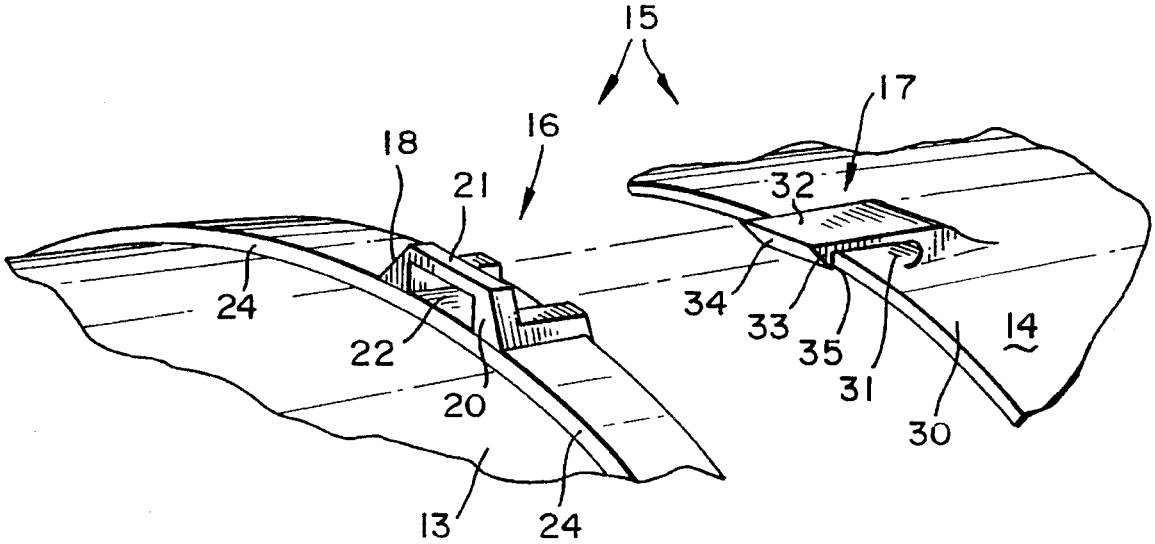
FIG. 7 is a fragmentary perspective view of two housing body parts of the volute housing body, and illustrates the axial alignment of a male and female fastener prior to securing the same to each other.
Figure 8:
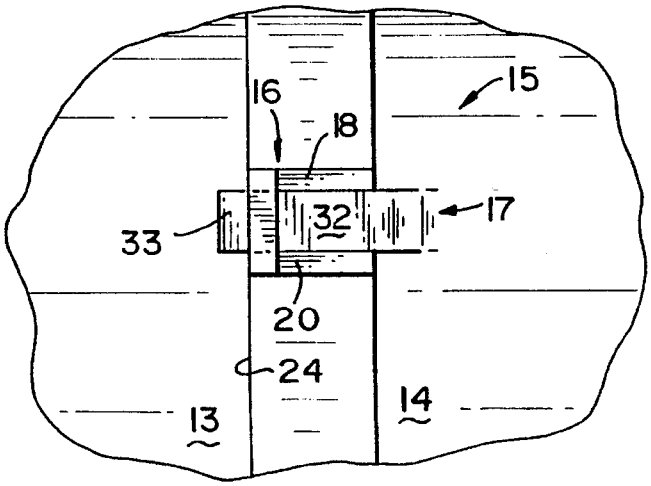
FIG. 8 is a reduced fragmentary elevational view of the snap fasteners of FIG. 7 and illustrates the male and female snap fasteners in assembled snap-secured relationship to each other.

The edges 13, 14 carry pairs of fasteners 15 defined by female fasteners 16 carried by the edge 13 and male fasteners 17 carried by the edge 14 (FIGS. 2, 3, 6–8). The female fasteners 16 include a pair of radially projecting spaced legs 18, 20 (FIG. 2) spanned by a bridge 21 and collectively defining a female opening 22. An undersurface 23 of the bridge 21 is curved to define a converging entrance (unnumbered) of the female opening 22. To the left and below each female opening 22, as viewed in FIGS. 6 and 7, is a ledge 24. Projecting to the right of the ledge 24, again as viewed in FIGS. 6 and 7, is an offset projection or nose 25 defining a terminal end of the edge 13 and a generally internal peripheral recess 26 thereof. A terminal end 30 of the edge 14 (FIGS. 6 and 7) is spaced by a gap or space 31 from a tongue or projection 32 ending in a radially inwardly directed locking lip 33. The locking lip 33 has an angled entrance surface 34 and a locking surface 35 which lies in a plane generally normal to an axis A (FIG. 2) of the volute housing parts 11, 12 and generally circular fluid inlet openings 51, 52 in respective sidewalls 41, 42 (FIGS. 1–4). The width of the tongue 17 corresponds to the width of the female opening 22 (see FIG. 8) and the thickness of the nose 25 corresponds to the radial width of the gap 31.

Figure 2:
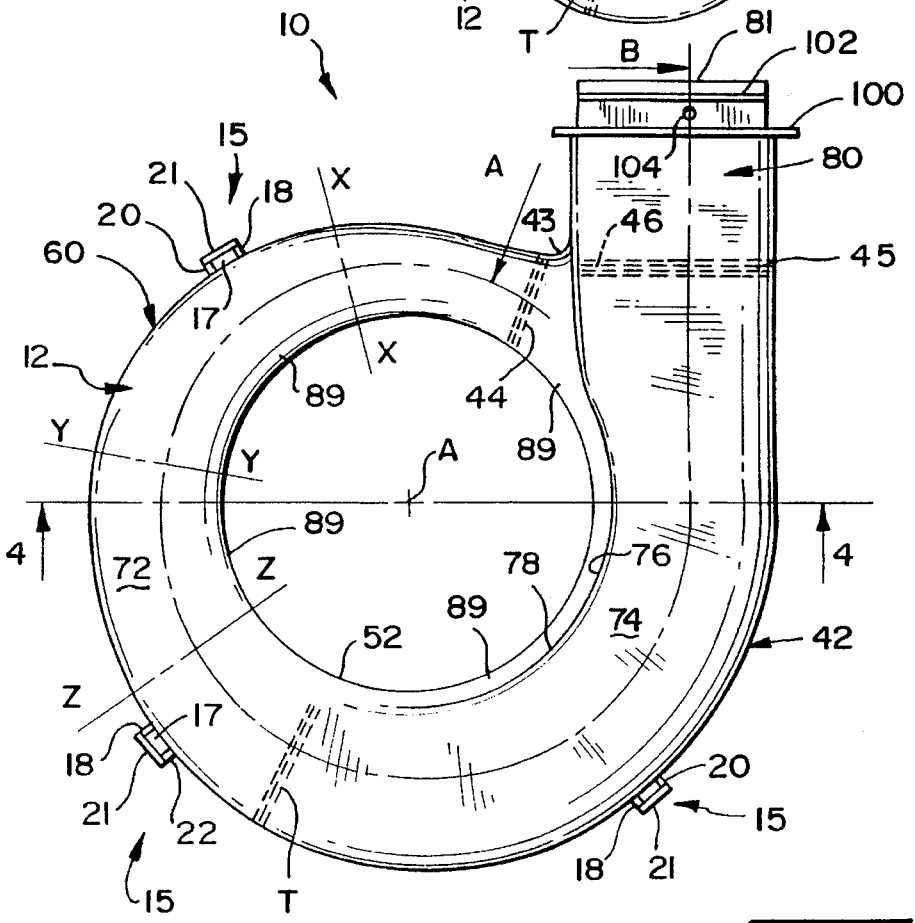
FIG. 2 is an enlarged side elevational view of the volute housing of FIG. 1, and illustrates structural details of the volute housing.
Figure 3:
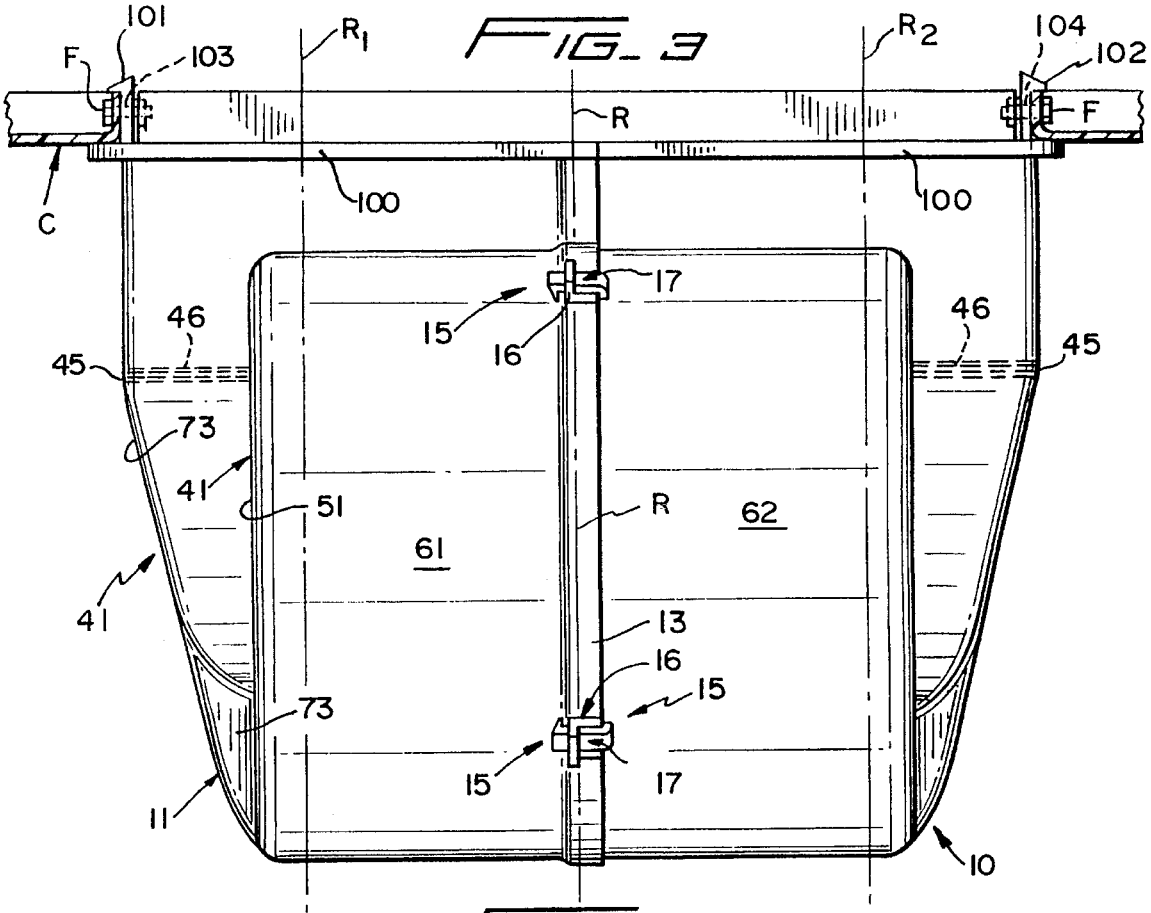
FIG. 3 is an enlarged perspective view of the volute housing of FIGS. 1 and 2, and illustrates the construction thereof from two housing parts snapped together by male and female fasteners with the volute housing being snap-secured in an opening of a convector tray or pan of a fan coil unit.

In order to assemble the housing parts 11, 12 into the volute housing 10 to the configuration shown in FIGS. 1 through 3, the two halves 11, 12 are aligned with each other with each of the tongues 32 aligned with an associated female opening 22 in the manner shown in FIG. 6 (left-hand-most illustration). The two halves 11, 12 are then moved toward each other at which time the surface 34 moves along the nose 25 and is deflected slightly upwardly thereby eventually contacting the divergent portion (unnumbered) of the undersurface 23 of the bridge 21 as the nose 25 moves into the gap 31 (FIG. 6, center illustration). In this fashion the bridge 21 prevents the tongue 32 from being deflected excessively upwardly, and when finally mated, the inherent resilience of the tongue 32 causes the same to rebound to the right-hand-most position shown in FIG. 6 at which time the locking surface 35 abuts against the ledge 24. In order to unlock the housing parts 11, 12 and disassemble the volute housing 10, the tongues 32 are deflected upwardly sufficiently for the surfaces 35 to clear the ledges 24 which is controlled by the undersurface 23 of the bridge 21. The bridge 21 also prevents each tongue 32 from being deflected excessively and being broken during the disengagement of the surfaces 35 from the ledges 24. Once the latter disengagement occurs, the housing parts 11, 12 can be simply pulled apart to disassemble the same.

The volute housing 10 includes a volute peripheral wall 60 defined by a volute peripheral wall portion 61 of the volute housing half or part 11 and a volute peripheral wall portion 62 of the volute housing part 12. The volute peripheral wall 60 extends generally from a volute tongue or cut-off 43 which is located generally at a first zone 44 of minimum radial dimension or distance relative to the openings 51, 52 to a second zone 45 located at a volute throat 46. The direction of fluid flow is counterclockwise relative to the volute peripheral wall 60, as viewed in FIG. 2, and as is best illustrated in FIG. 2, the sidewall 42 progressively increases in radial size in the direction of fluid travel from the first zone 44 of minimum radial dimension to the second zone 45 of maximum radial dimension. The arcuate distance between the first zone 44 and the volute tongue or cut-off point 43 and the second zone 45 or volute throat 46 in the direction of fluid flow is generally 360° (FIGS. 2 and 6).

Each of the sidewalls 41, 42 includes respective first sidewall portions 71, 72 and second sidewall portions 73, 74. The first sidewall portions 71, 72 are in generally parallel relationship to each other (FIG. 5) and extend approximately 180° from the first zone 44 to a transition zone T (FIGS. 2 and 5). As viewed in FIGS. 2 and 5, the transition zone T is located approximately 180° from the first zone 44 and tongue 43, as measured counterclockwise in FIG. 2. Thus, fluid/air flow between generally the tongue or cut-off 43 and the first zone 44 up to the transition zone T will be confined radially against expansion by the generally parallel sidewall portions 71, 72. After the transition zone T and up to the second zone 45/volute throat 46, the second wall portions 73, 74 diverge away from each other in the direction of fluid flow, as is best illustrated in FIG. 5. Thus, the fluid/air travelling from the transition zone T to the volute throat 46/second zone 45 will expand radially outwardly eventually exiting through a generally polygonal discharge nozzle 80 having a discharge opening 81. The cross sectional configuration at the volute throat 46 corresponds to the cross sectional configuration of the discharge opening 81 of the discharge nozzle 80, and thus between the volute throat 46 and the discharge opening 81, no further expansion of the fluid/air takes place.

Axial transition walls 75, 76 (FIGS. 1 through 4) bridge between the respective openings 51, 52 and the second sidewall portions 73, 74, respectively, of the sidewalls 41, 42, respectively. The axial transition walls 75, 76 merge very abruptly with the respective second sidewall portions 73, 74 at sharp radii or radius portions 77, 78, respectively (FIGS. 1, 2 and 4). The radii 77, 78 are relatively abrupt (FIG. 4) and merge with less abrupt radii or radius portions 79, 89, respectively (FIGS. 1, 2 and 4). The axial transition walls 75, 76 and the respective radii 77, 78 begin at the transition zone T and progressively widen radially (see FIG. 1) to the volute throat 46/second zone 45. While the abrupt radii 77, 78 extend generally only between the transition zone T to the volute throat 46/second zone 45, the less abrupt radii 79, 89 extend a full 360° about the respective openings 51, 52 (FIGS. 1 and 4). Because of the latter construction a continuous uniform circumferential inlet cap is formed between an impeller (not shown) associated with the volute housing 10 and the gradual radii 79, 89 thereof. This causes uniform circumferential air flow into the volute housing 10 which balances not only the air flow, but in turn balances the torque on the impeller, its shaft and the associated drive motor (not shown) resulting in minimal vibration. The transition walls 75, 76 are generally in parallel relationship to the portions of the volute peripheral wall portions 61, 62 radially opposite thereto. Accordingly, as fluid/air flows between the transition zone T and the volute throat 46/second zone 45, the fluid/air can expand radially outwardly because of the divergent nature of the second wall portions 73, 74 but is constrained against radial expansion until reaching the volute throat 46/second zone 45.

From the foregoing, the radial cross section through the first zone 44 defines the minimum cross sectional volume of the volute fluid chamber (unnumbered) with, of course, the fluid chamber being established generally as that volume between the volute peripheral wall 60 and the inlet openings 51, 52 or the outer periphery of an impeller (not shown) mounted in the volute housing 10. This cross sectional volume progressively increases in the direction of fluid/air flow as, for example, in the direction of selected radial planes X—X, Y—Y, Z—Z, etc. until reaching a maximum at the transition zone T. However, during the enlargement of the volumes between generally 0° and 180°, all of the enlargement of chamber volume is through radial expansion and not through axial expansion because of the generally parallel relationship of the first sidewall portions 71, 72 of the respective sidewalls 41, 42. However, the cross sectional volume of the air/fluid chamber beginning at the transition zone T progressively increases toward the second zone 45/volute throat 46, not only radially but also axially, because of the progressive divergence of the second sidewall portions 73, 74 toward and to the volute throat 46/second zone 45. At the latter zone the cross sectional volume remains generally unchanged as it passes through the discharge nozzle 80 exiting the discharge opening 81 thereof. Due to the divergence of the second sidewall portions 73, 74 in conjunction with the transition walls 75, 76 between the transition zone T and the second zone 45/volute throat 46, the efficiency of the overall volute housing 10 is increased while the noise/sound is decreased even though uniform compression is maintained only over approximately 0°–180° from the first zone 44 to the transition zone T. However, releasing the compression and providing expansion from the transition zone T toward discharge particularly in an axial direction, has achieved efficiency beyond that heretofore obtained at noticeably decreased noise levels.

The volute housing 10 is also provided with an abutment flange 100 (FIGS. 1 and 3) which extends about the exterior of the discharge nozzle 80 downstream from the discharge opening 81. The flange 100 abuts against the bottom of a convection tray C (FIG. 3) in the manner fully described in applicant's U.S. Pat. No. 5,042,269 issued Aug. 27, 1991 entitled "A Fan Coil Unit." The specifics of the latter, including details of oppositely directed connected tongues or flanges 101, 102 are herein incorporated by reference. However, in addition to the flanges or tongues 101, 102, openings 103, 104 are formed in the discharge nozzle 80 immediately adjacent and below each of the flanges or tongues 101, 102 through which fasteners F (FIG. 3) can be connected to suspendingly secure the volute housing 10 to the convector tray C.

Reference is now made to FIG. 4 which illustrates a modification of the invention in which transition walls 75', 76' are not parallel to the volute peripheral wall 60 but instead are modified to gradually flare from the respective openings 51, 52 toward the respective volute peripheral wall portions 61, 62 of the volute peripheral wall 60 The transition walls 75', 76' now gradually blend with the transition radii 77, 78 between the transition walls 75', 76' and the less abrupt radii 79, 89, respectively, resulting in less cavitation, less noise and still greater efficiency than the more abrupt (90°) transition earlier described between the walls 73, 75 and 74, 76.

Figure 9:
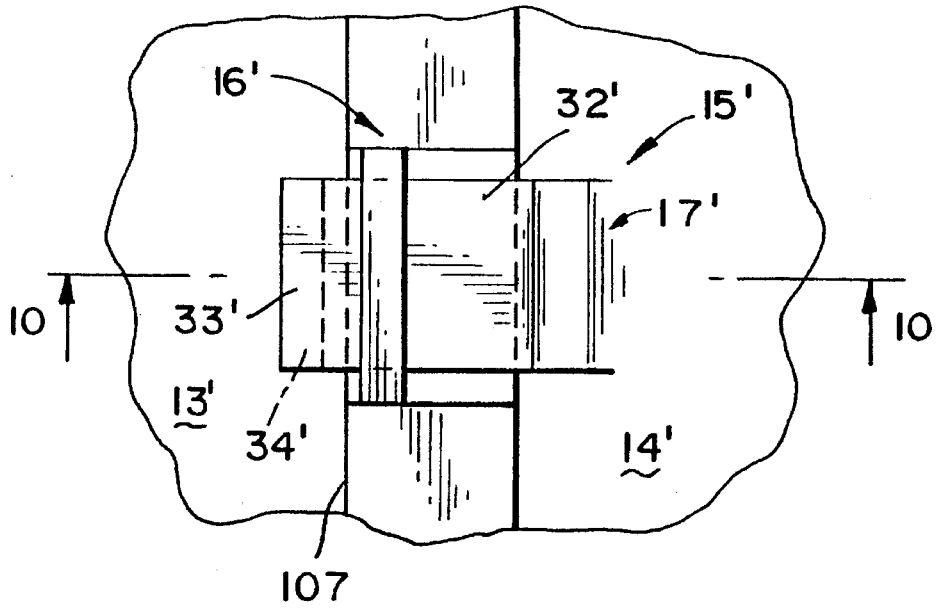
FIG. 9 is a fragmentary elevational view of another pair of male and female snap fasteners, and illustrates the fasteners in secured relationship to each other.
Figure 10:
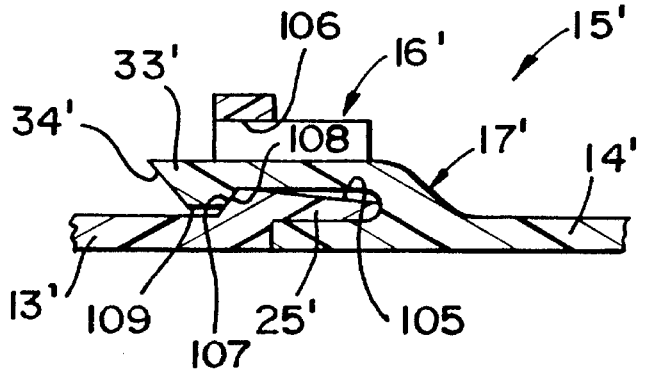
FIG. 10 is a fragmentary cross sectional view taken generally along line 10—10 of FIG. 9, and illustrates details of the secured fasteners.
Figure 11:
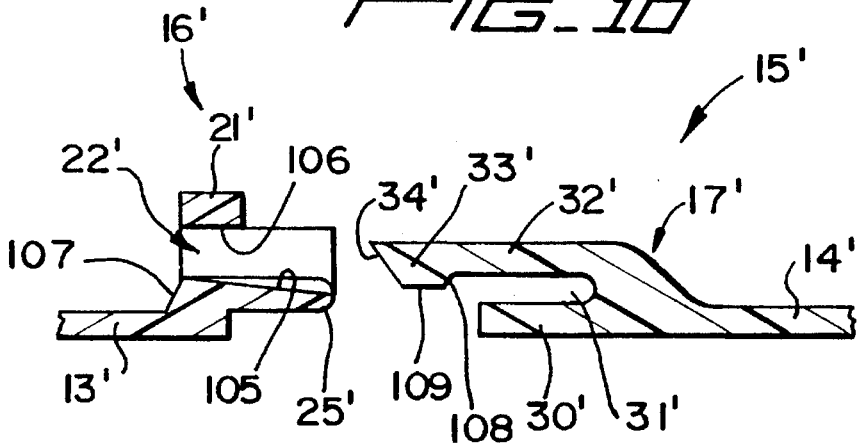
FIG. 11 is a fragmentary cross sectional view similar to FIG. 10 and illustrates the snap fasteners in unfastened relationship to each other.

Reference is now made to FIGS. 9 through 11 of the drawings which illustrates another pair of fasteners 15' which have been primed to designate structure substantially identical to that of the pairs of fasteners 15. In this case a female fastener 16' includes an offset projection or nose 25' but an upper surface 105 thereof is inclined downwardly and to the right, as viewed in FIGS. 10 and 11. An undersurface 106 of a bridge 21' is not provided with a converging entrance surface, as in the case of the undersurface 23 of the bridge 21. Furthermore, a ledge 107 is slightly inclined upwardly and to the right as viewed in FIGS. 10 and 11, as opposed to the generally normal disposition of the ledge 24 relative to the edge 13 of the female fastener 16 (FIG. 6). The male tongue or projection 32' includes a locking lip 33' and a forward inclined surface 34'. However, a rearward surface 108 is inclined and a bottommost surface 109 is generally flat. Thus the locking lip 33' is not pointed, as in the case of the locking lip 33 of FIG. 6.

In order to fasten the fasteners 16', 17', the tongue 32' is moved to the left, as viewed in FIG. 11, and the surface 109 is progressively guided by the surface 105 to feed the locking lip 33' through the female opening 22' which also progressively deflects the tongue 32' upwardly toward and against the underside 106 of the bridge 21'. The bridge 21' prevents the tongue 32' from being over deflected during this fastening operation, and once the locking lip 33' moves beyond the female opening 22', the surfaces 107, 108 lockingly engage each other (FIG. 9) with sufficient force to maintain the fastening means 15' assembled. However, since the surfaces 107, 108 are inclined, release thereof is easier than that heretofore described in conjunction with the surface 35 and ledge 24 of the pair of fasteners 15 which are generally normal to the direction of disassembly. The latter is readily apparent by merely comparing FIG. 10 with the right-hand-most illustration of FIG. 6. However, even with the tapered surfaces 107, 108, the grip is sufficiently adequate to assure that the volute housing 10 is maintained in its assembled condition.

Figure 12:
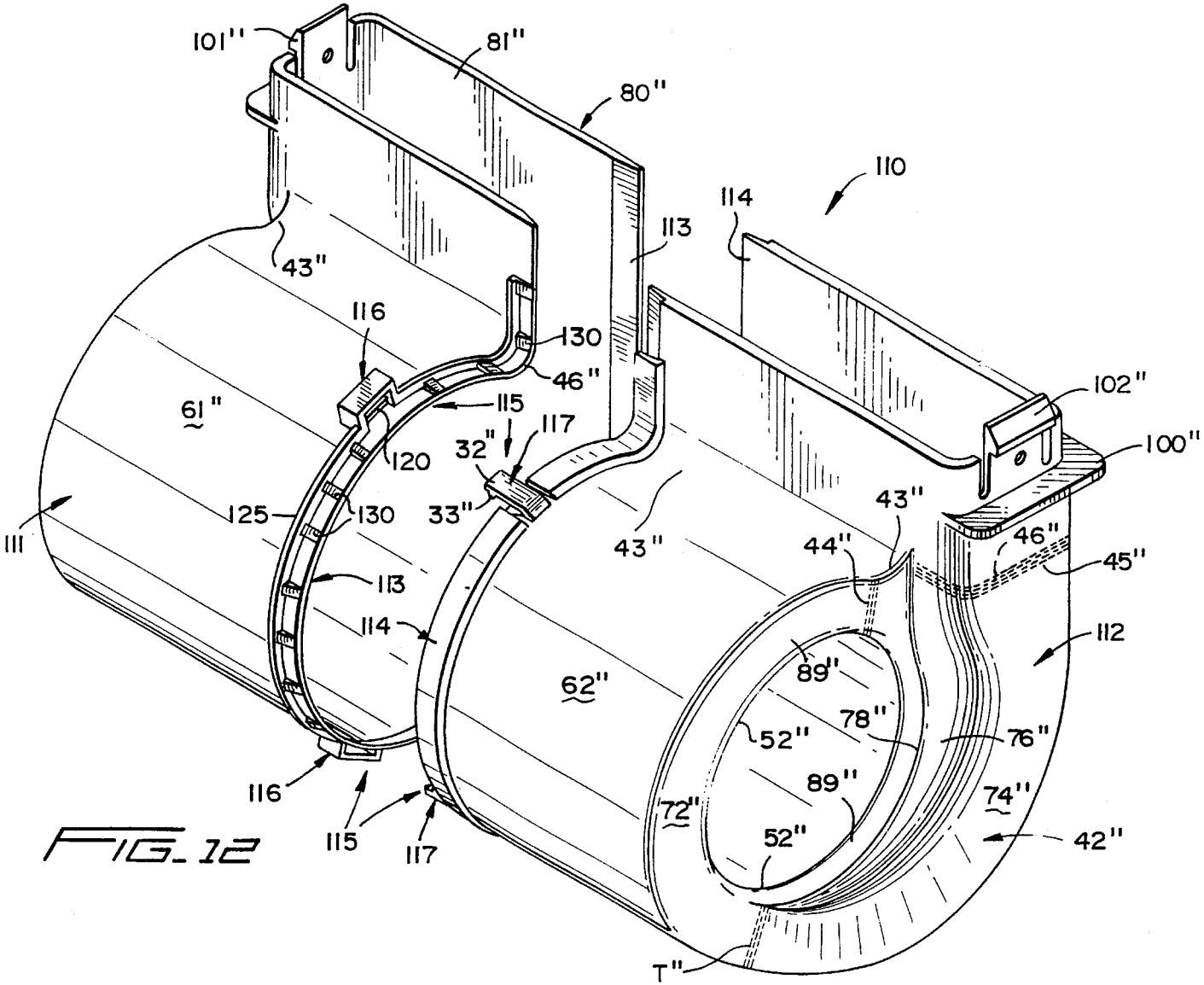
FIG. 12 is a perspective view of another novel volute housing constructed in accordance with this invention, and illustrates a pair of volute housing bodies or parts having peripheral edges adapted to be snap-fastened to each other.

Another volute housing constructed in accordance with this invention is illustrated in FIG. 12 and is generally designated by the reference numeral 110.

Structure of the volute housing 110 which is identical to that of the volute housing 10 has been double primed.

The volute housing 110 includes a housing body defined by a pair of housing parts or halves 111, 112. The housing parts 111, 112 are joined to each other along a generally radial plane (unnumbered) corresponding to the radial plane R of FIGS. 3–5. The housing parts 11, 12 are joined to each other along the radial plane through interlocked edges 113, 114 through pairs of fasteners 115 defined by female fasteners 116 carried by the edge 113 and male fasteners 115 carried by the edge 114.

Figure 13:
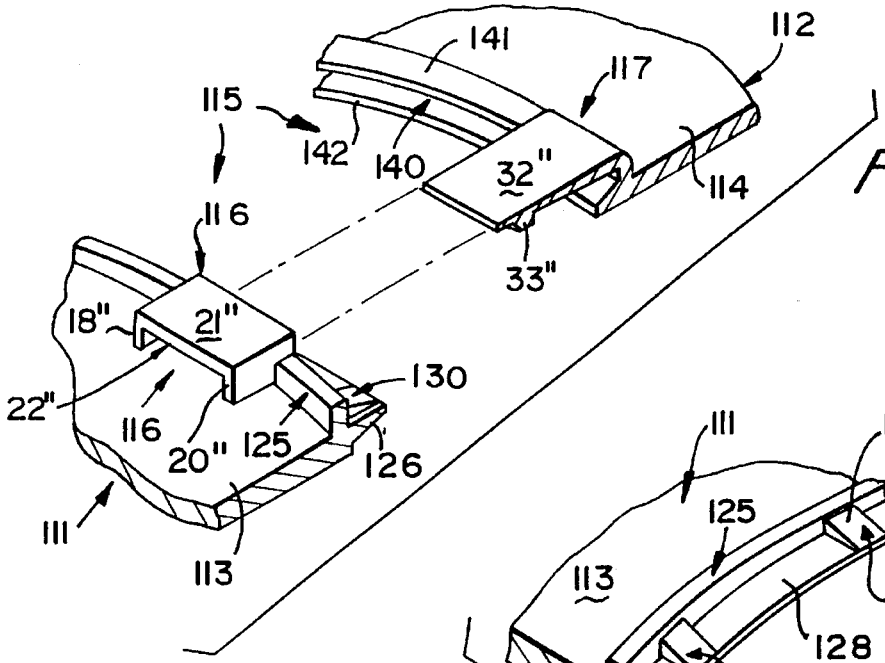
FIG. 13 is a fragmentary enlarged view of a portion of the peripheral edges of the volute housing parts or halves, and illustrates axial alignment of male and female fasteners prior to securing the same to each other, and a nose of one peripheral edge aligned with a channel of the other peripheral edge.

The female fasteners 116 each include a pair of radially projecting spaced legs 18", 20" (FIG. 13) spanned by a bridge 21" and collectively defining a female opening 22". Within each female opening 22" and spaced beneath the bridge 21" thereof is located a generally radially outwardly directed circumferentially extending locking rib 120 having a first inclined surface or face 121, a second inclined surface or face 122, and a top surface or face 123 therebetween. Each of the male fasteners 117 is substantially identical to the male fastener 17' of FIGS. 9 through 11, and includes a tongue or projection 32", a radially inwardly directed locking lip 33" and a surface 108" which locks against the surface 122 of the locking rib 120 when the pairs of fasteners 115 are fastened together in the manner clearly evident in FIG. 15. The assembly and disassembly of the pairs of fasteners 115 need not be described further since the same corresponds to that heretofore described relative to the pairs of fasteners 15' of FIGS. 9 through 11.

Figure 14:
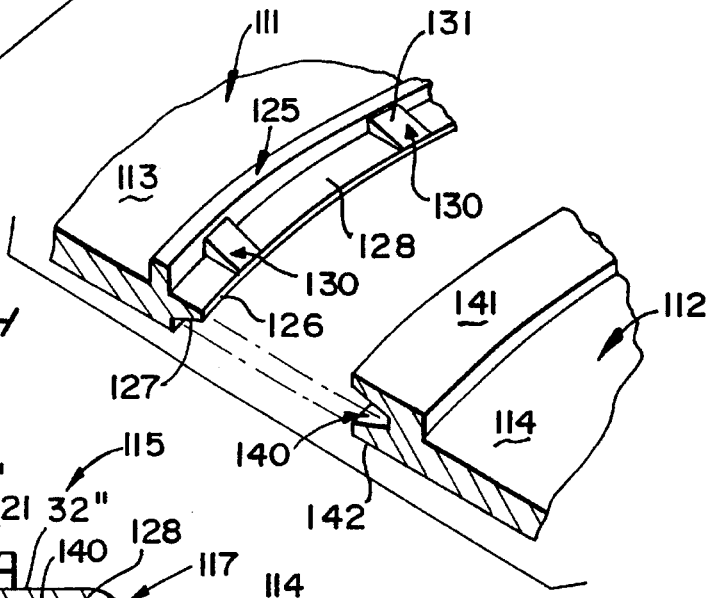
FIG. 14 is a fragmentary perspective view similar to FIG. 13, and illustrates a plurality of circumferentially spaced reinforcing bosses carried by one of the peripheral edges.
Figure 15:
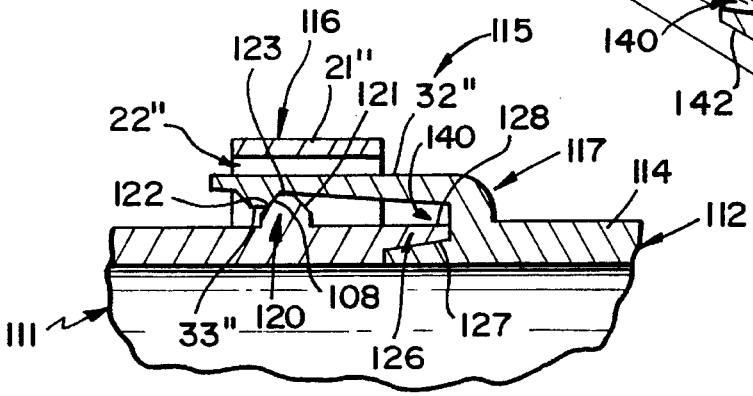
FIG. 15 is a fragmentary cross sectional view illustrating the assembled condition of the volute housing body and illustrates the fasteners interconnected to each other with a nose received in a slot or groove.
Figure 16:
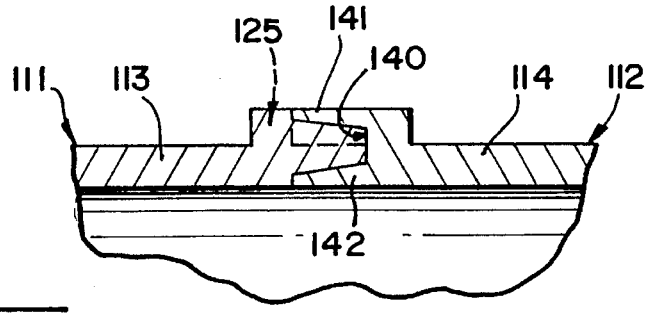
FIG. 16 is a fragmentary cross sectional view similar to FIG. 5, and illustrates the mating configuration between the groove and one of the bosses.
Figure 17:
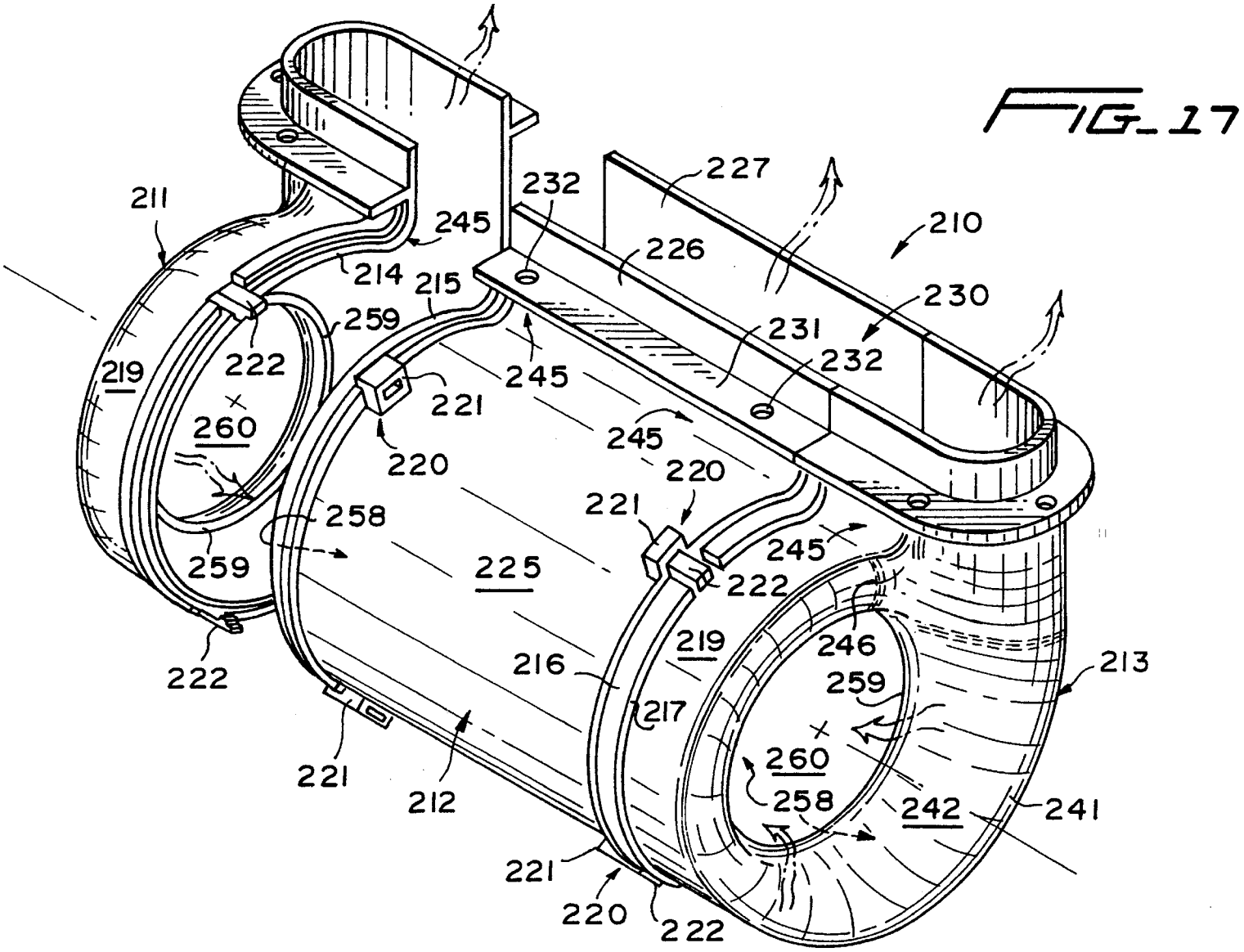
FIG. 17 is a perspective view of another novel volute housing constructed in accordance with this invention which is also particularly adapted for utilization with a centrifugal fan, blower or the like, and illustrates a three-piece construction defined by a volute peripheral wall formed of plastic or metal, a pair of plastic sidewalls associated therewith, circular fluid inlet openings associated with each side wall, and side wall portions which diverge progressively axially outwardly and in the direction of fluid flow between a tongue and a throat or discharge area of the volute generally circumscribing therebetween up to approximately 350°.
Figure 18:
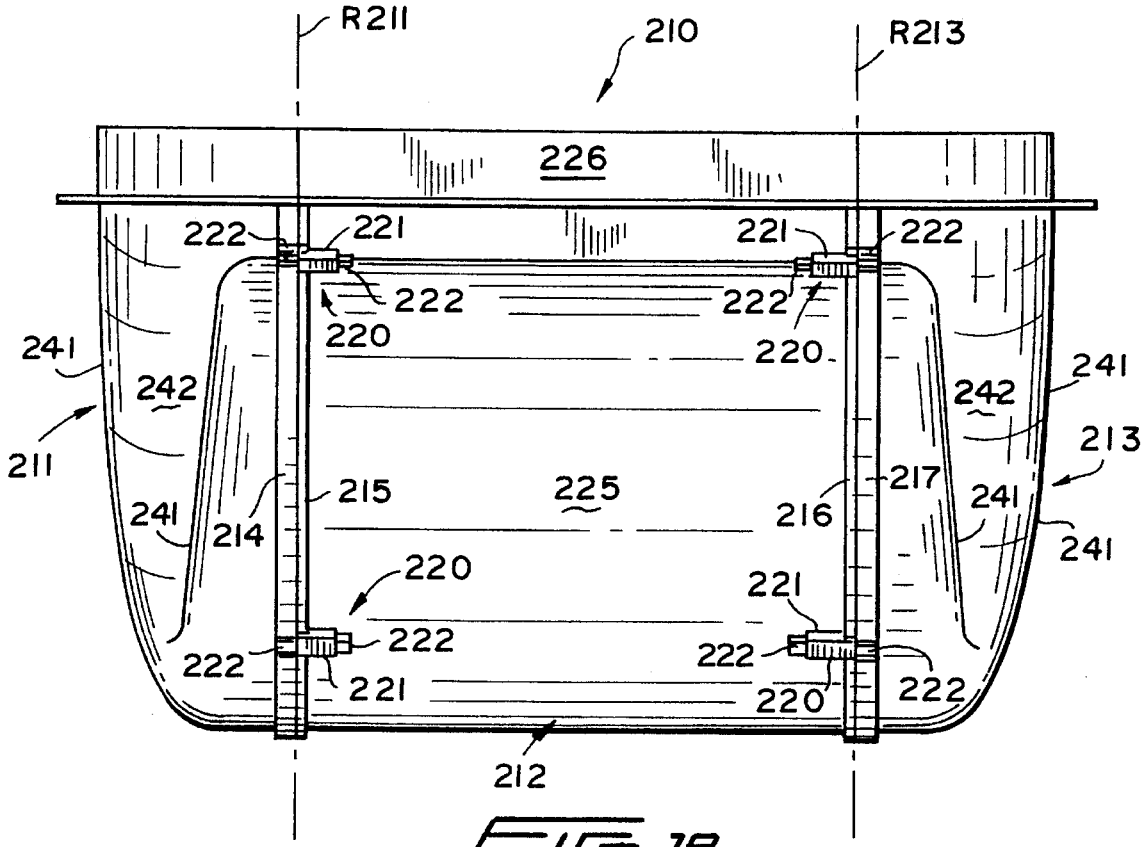
FIG. 18 is an enlarged front elevational view of the volute housing of FIG. 17, and illustrates the construction of the three housing parts snap-fit together.
Figure 19:
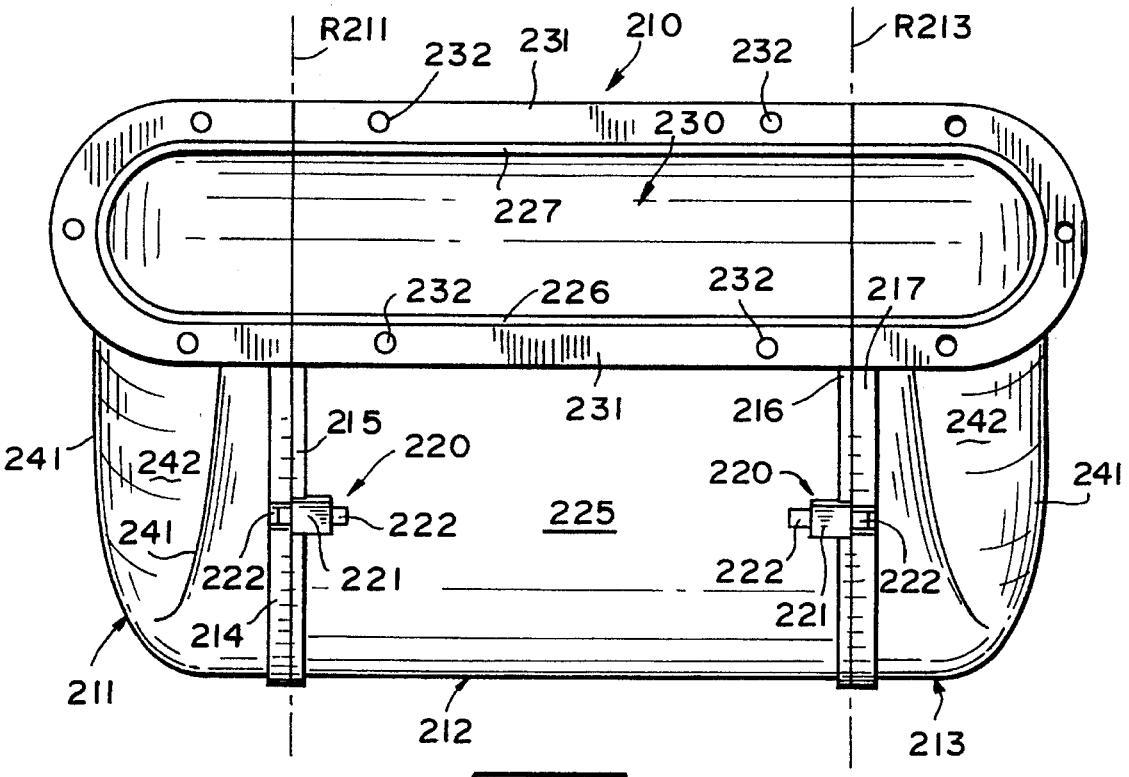
FIG. 19 is a top plan view of the volute housing of FIG. 18 rotated about its axis, and better illustrates a discharge opening and the manner in which opposite sidewall portions of the sidewall diverge away from each other in a direction from the tongue toward the throat/discharge opening.
Figure 20:
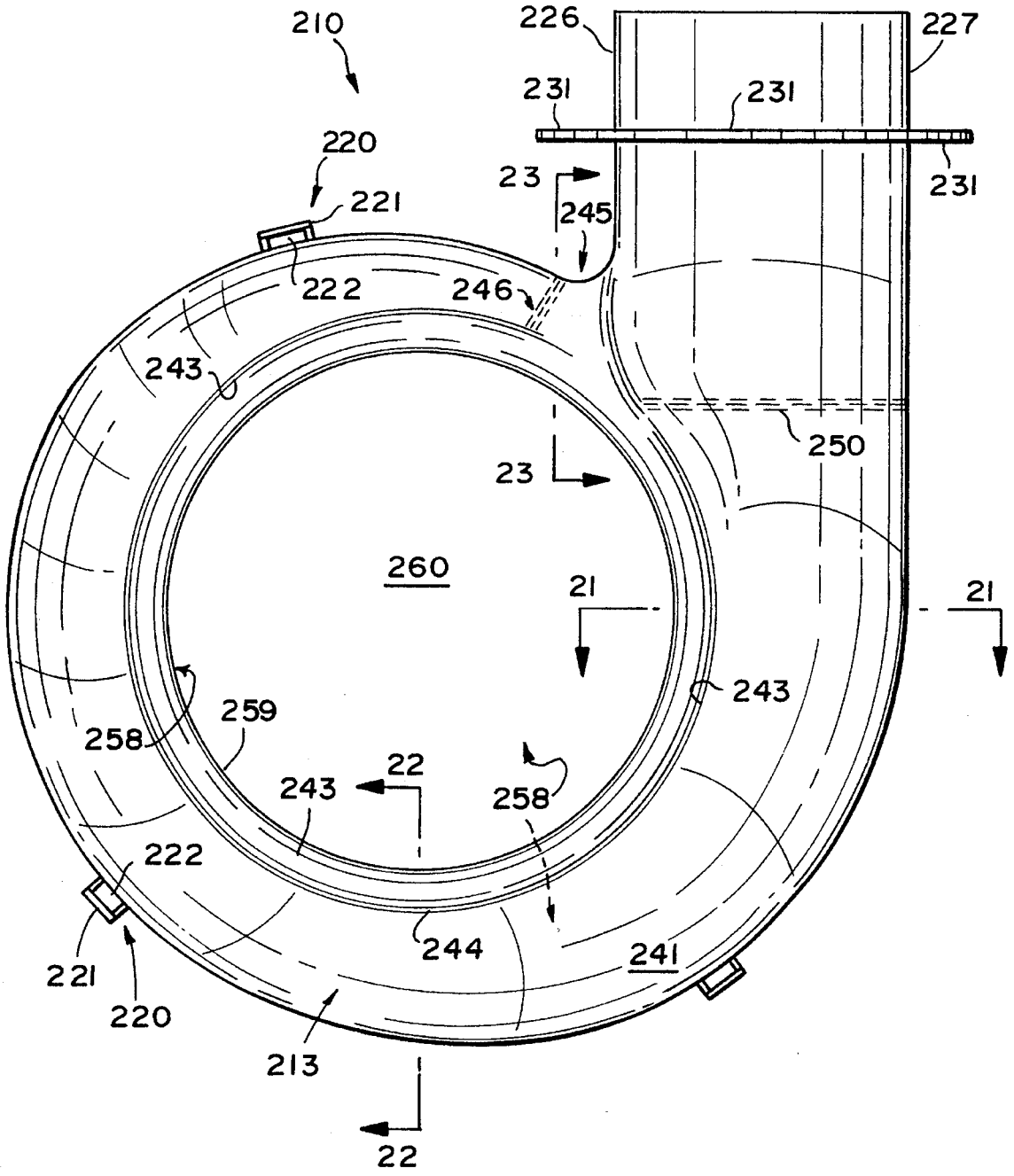
FIG. 20 is an enlarged side elevational view of the volute housing of FIGS. 17 through 19, and fully illustrates the continuous divergence of the sidewall in a radial direction from the tongue to the throat.

The edge 113 also includes a circumferentially extending radially outwardly directed reinforcing rib 125 forward from which projects a nose 126 having a tapered bottom surface 127 and a relatively flat upper surface 128 (FIG. 14 and 15). A plurality of reinforcing bosses 130 are spaced peripherally from each other, and each includes an upper tapered surface 131. The surfaces 127, 131 merge at a circumferential flat front surface or face 132. The surfaces 127, 131 and 132 are of a transverse cross sectional configuration (FIG. 16) which corresponds to an axially outwardly opening groove or channel 140 defined between a pair of flanges 141, 142 (FIGS. 13 and 16) of the edge 114. The surfaces (unnumbered) of the channel or groove 140 mates with the surfaces 127, 131 and 132, and lends rigidity to the volute housing 110 when the volute parts 111, 112 are held together by the fasteners 115. Since the volute housing parts 111, 112 are formed from injection molded plastic, the tendency thereof is to deflect or warp, particularly along the edges 113, 114 unless otherwise provided for. The spaced bosses 130 and the rib 125 provide both axial and circumferential rigidity to the edge 113 which prevents the same from warping and thus maintains its rigidity over the lifetime thereof. Obviously since the edge 113 is extremely rigid and relatively nondeflectable, once the interlock of FIGS. 15 and 16 is effected between the nose 126 and the groove 140, the rigidity inherent in the edge 113 also rigidifies the interlock and thus the overall connection about the entire periphery of the housing parts 11, 112 along the entire interlock edges 113, 114.

Though the volute housings 10 (FIG. 1) and 110 (FIG. 12) have been described as being formed of two volute parts or bodies 11, 12 and 111, 112, respectively, the same can be made of more numbers of parts, though the same are preferably divided along planes parallel to the radial plane R (FIGS. 3 and 4). For example, two planes R1, R2 (FIGS. 3 and 4) are illustrated, one to either side of the radial plane R. In accordance with this invention the entire portion of the volute housing 10 located between the radial planes R1, R2 could be a single piece of injection molded plastic material, as would be the housing portions to the left and right of the radial planes R1, R2, respectively. These three parts then could be glued together or adjoining parts could be provided with pairs of fasteners, such as the fasteners 15. As an alternative construction, the parts of the volute housing 10 to the left and right, respectively, of the radial planes R1, R2 can be made of injection molded plastic material, whereas the part of the volute housing 10 between the radial planes R1, R2 can be made of galvanized metal. The peripheral edges of the housing parts to the left and right of the radial planes R1, R2, respectively, could be provided with grooves into which would be received the peripheral edges of the galvanized central part, and these could all be appropriately glued to each other. In this fashion one need but mold opposite axial ends of the volute housing 10 and a central portion could be varied in axial length to accommodate different impellers of different axial length.

Another novel volute housing for a centrifugal fan, blower or the like is illustrated in FIGS. 17 through 23 of the drawings and is generally designated by the reference numeral 210.

The volute housing 210 includes a housing body defined by housing parts 211, 212 and 213. The housing parts 211, 213 define sidewalls of the housing 210, while the housing part 212 defines a central body portion or volute peripheral wall of the volute housing 210. The sidewalls 211, 213 are formed from polymeric/copolymeric plastic material, while the central body portion or part 212 is preferably formed from synthetic polymeric/copolymeric plastic material, but also can be formed from metal. The housing parts 211, 212 and 212, 213 are joined to each other along generally parallel radial planes R211, R213, respectively (FIGS. 18 and 19), through respective interlocked edges 214,215 and 216, 217, respectively.

The edges 214, 215 and 216, 217 carry pairs of fasteners 220 defined by female fasteners 221 carried by the edges 215, 216 and male fasteners 222 carried by the edges 214, 217. The fasteners 221, 222 are identical to the fasteners 16, 17 (FIG. 7) 6f the volute housing 10, and the description of the latter is applicable to the former. Thus, in order to assemble the housing parts 211, 212 and 213 into the volute housing 210 of the configuration shown in FIGS. 18 through 20, the parts or body portions 211 through 213 are aligned with each other and are snap-secured together through the interlocking of the male fasteners or tongues 222 with and in the female fasteners 221.

The central part or central body portion 212 of the volute housing 210 includes a volute peripheral wall 225 which is curved for an appreciable portion of its periphery and merges with generally parallel wall portions 226, 227 defining a discharge opening 230. Each of the walls 226, 227 includes a flange 231 normal thereto having openings 232 formed therein. The openings 232 are adapted to receive fasteners for securing the volute housing 210 to a condensation pan or tray of a heat pump.

The volute peripheral wall 225 extends generally from a volute tongue or cut-off 245 which is located generally at a first zone 246 of minimal radial dimension (See FIG. 23) to a second zone or volute throat 250 which are approximately but not quite circumferentially spaced 360° from each other, and somewhat closer to and preferably 350° from each other. The direction of fluid/air flow is counterclockwise, as viewed in FIG. 20, and in the latter figure, the sidewall 213 is clearly illustrated progressively increasing in radial size in the direction of fluid travel from the first zone 246 or tongue 245 of minimum radial dimension to the second zone or throat 250 which is adjacent but not precisely at the maximum radial dimension established by the overall cross-sectional area of the discharge orifice 230.

Figure 21:
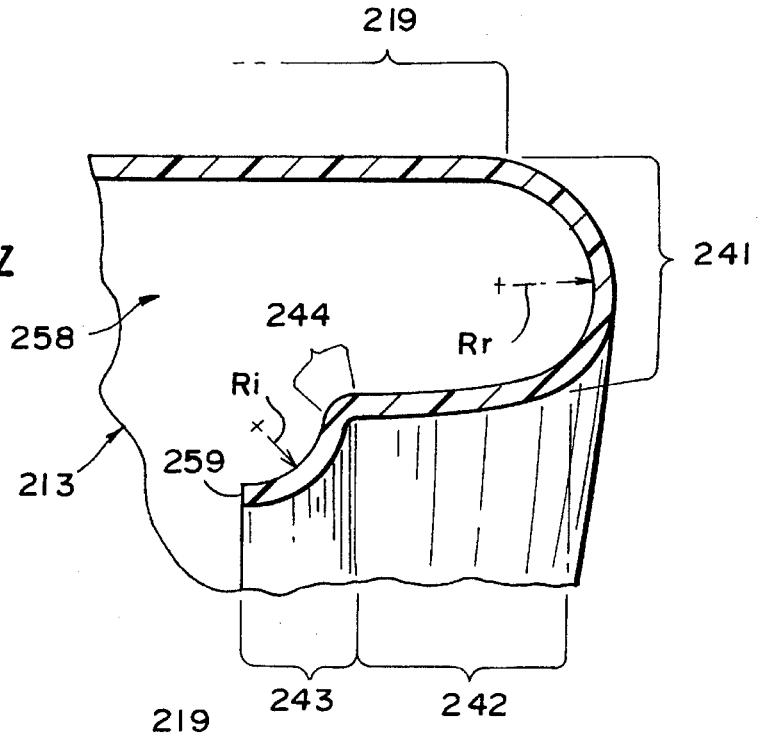
FIGS. 21 through 23 are enlarged cross-sectional views taken generally along lines 21—21, 22—22 and 23—23, respectively, of FIG. 20, and illustrates the manner in which a radial outermost sidewall portion and a medial sidewall portion respectively decrease in radius/curvature and radial length between the throat and the tongue of the associated sidewall.
Figure 22:
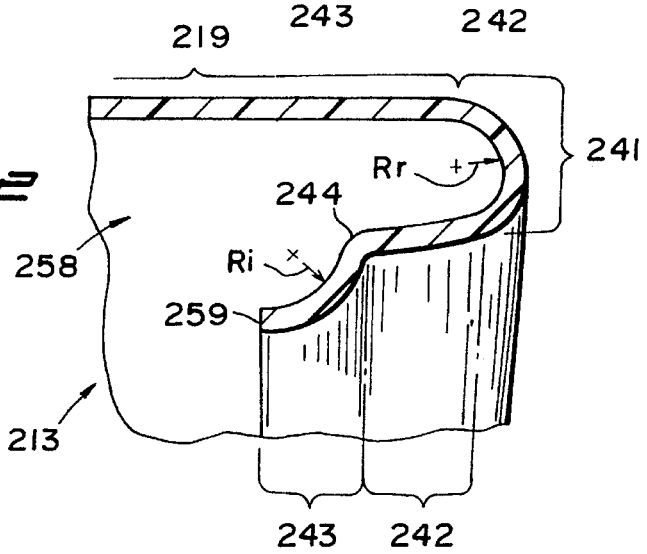
Figure 23:
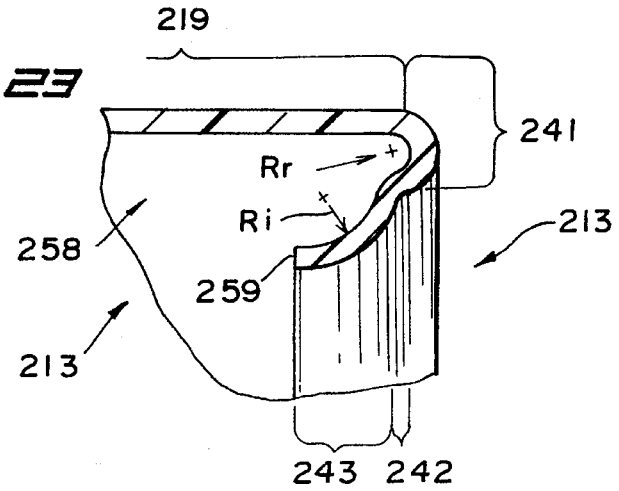
Figure 24:
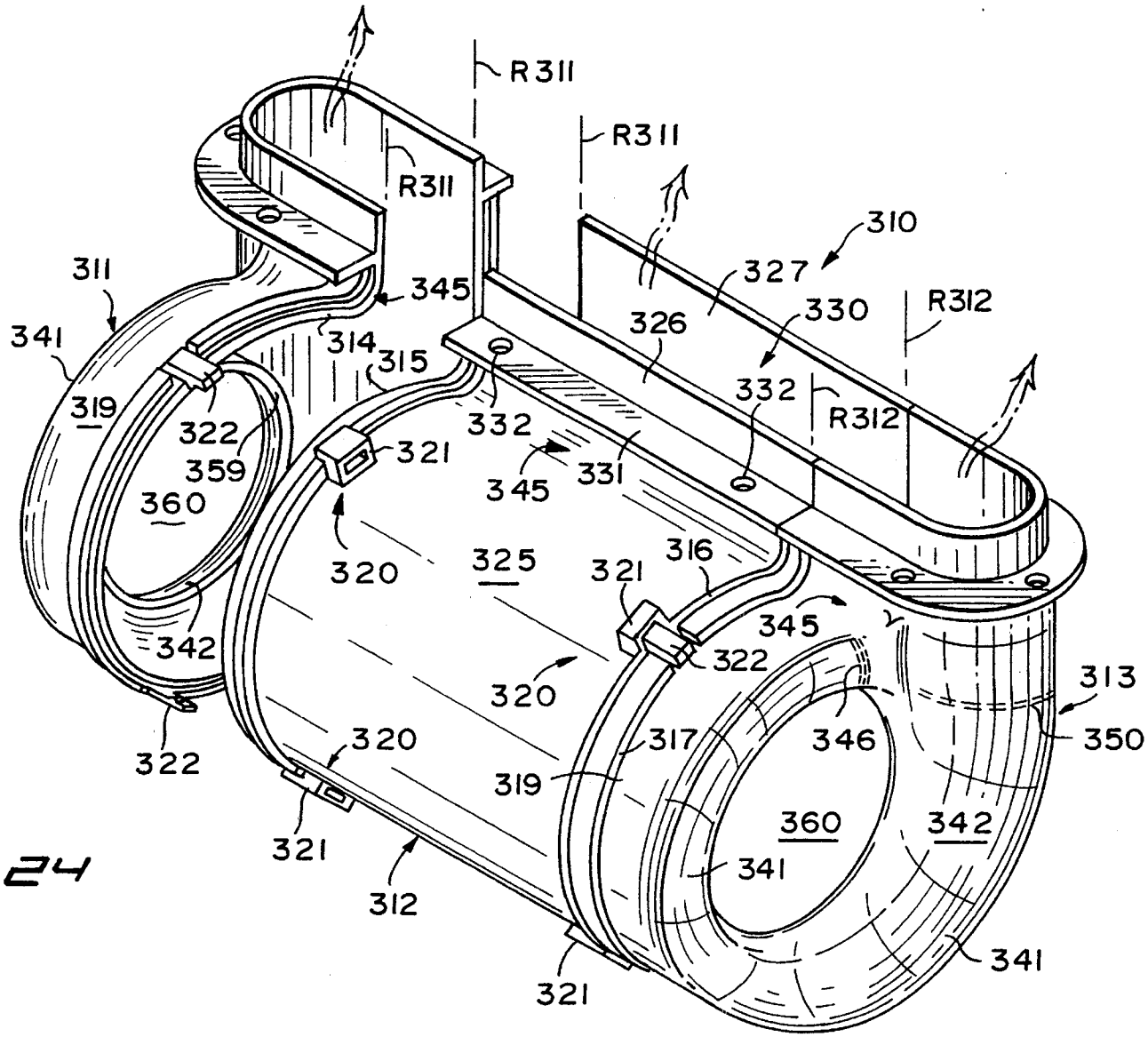
FIG. 24 is a perspective view of another novel volute housing constructed in accordance with this invention which is similar to the volute housing of FIGS. 17 through 23, but each sidewall excludes a portion corresponding to the medial sidewall portions of the volute housing of FIGS. 17 through 23.
Figure 25:
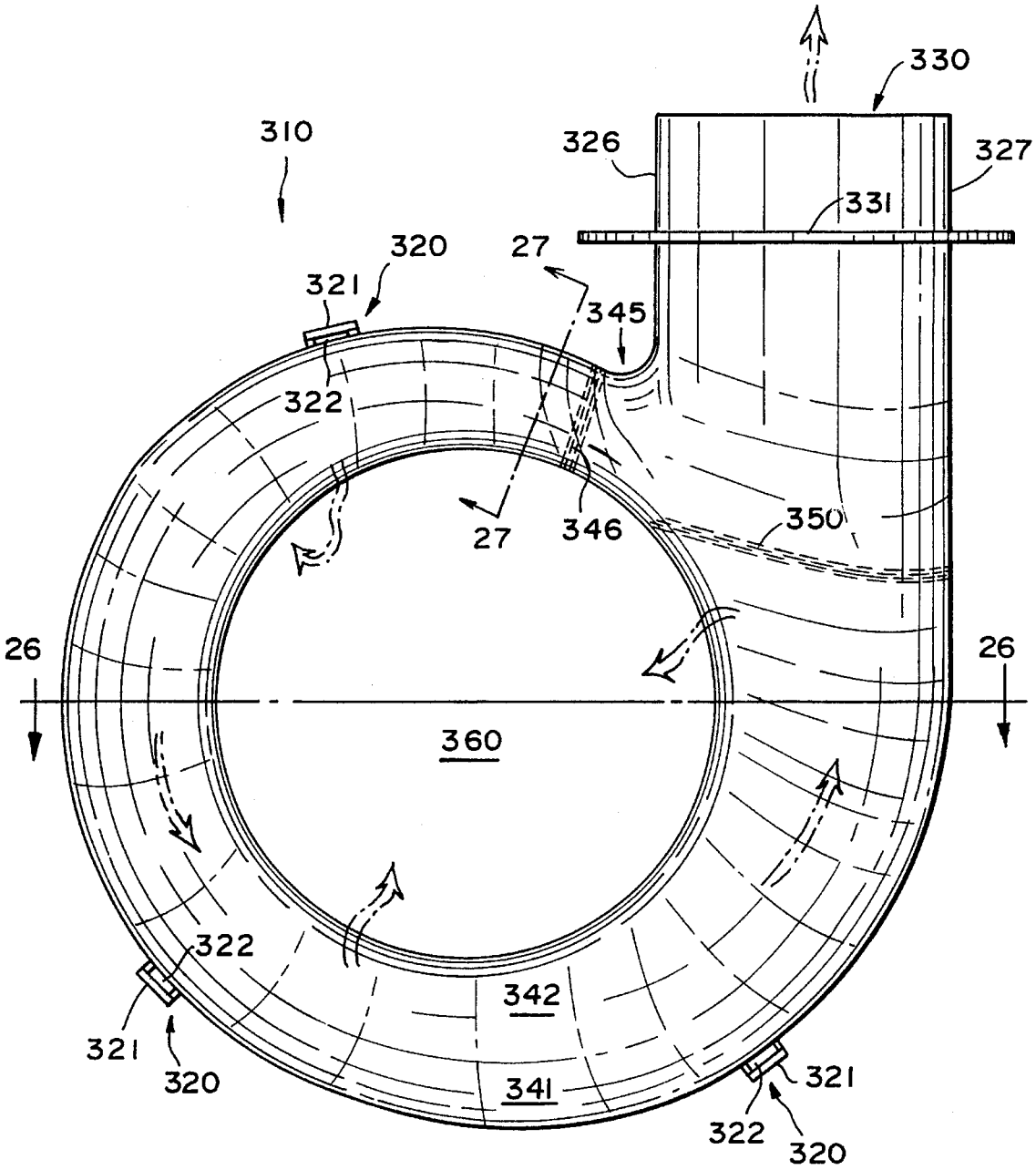
FIG. 25 is a side elevational view of the volute housing of FIG. 24, and illustrates the progressive and continuous radial increase of the illustrated sidewall between a tongue and throat thereof.

Since the sidewalls 211, 213 are identical, the following description of the sidewall 213 is applicable to the sidewall 211. The sidewall 213 includes a peripheral wall portion 219 (FIG. 21) which includes the edge 217, abuts the edge 216 of the volute peripheral wall 225 and merges with a radially outermost sidewall portion 241 defined by a radius Rr. The radially outermost sidewall portion blends or merges with the volute wall 225 and with a medial sidewall portion 242 of the sidewall 213. The medial sidewall portion 242 is in axial inwardly diverging relationship relative to the volute wall 225 and merges with a radially innermost sidewall portion 245 at an abrupt radius portion 244. The radially innermost portion 243 is defined by a radius Ri which imparts a relatively shallow inwardly opening concave configuration to the radially innermost wall 243. As will be seen by comparing FIG. 21 with FIG. 20, the illustration in FIG. 21 is a cross-section of the sidewall 213 adjacent the throat 250 and is illustrative of the radius Rr approaching its maximum size or curvature prior to air exiting the throat 250 and the discharge opening 230. Further upstream the radially outermost sidewall portion 241 is progressively narrower (See FIG. 22) and generally approaches its narrowest radial cross-section in the area of the tongue 245, as is illustrated in FIG. 23. During this same progressive lessening of the radius Rr from the throat 250 toward and to the tongue 245, the medial wall portion 242 also lessens or reduces in axial length, as is readily apparent from comparing FIGS. 21 and 23. Thus, though the radius Rr subtends an angle of approximately generally 180° along the sidewall 213 between the tongue 245 and the throat 250, the radius Rr progressively changes. In effect the radially outermost sidewall portion 241 and the medial sidewall portion 242 have a minimum radius and axial length, respectively, at the tongue 245 and/or first zone 246 of the volute chamber while having a maximum radius and axial length respectively adjacent the throat or second zone 250. Furthermore, the minimum radius and axial length each progressively increases from the first zone 246 or tongue 245 to the second zone 250, and the overall arcuate distance between these two first and second zones, 245 and 250, respectively approaches 360° but preferably is generally 350°. Thus, the sidewalls 211, 213 collectively define with the central body 212 a volute chamber 258 which progressively converges from the throat 245 to the discharge opening 230, as is clearly illustrated and exemplified in FIGS. 18 and 19, and equally apparent from FIGS. 21 through 23. Due to the latter construction, air drawn axially into circular axially aligned openings 260 defined by terminal edges 259 of each of the side walls 211, 213 is drawn smoothly into the volute chamber 258 in the absence of excessive and erratic eddy currents and turbulence and similarly expands from the tongue 245 progressively toward and outwardly of the throat 250 in a smooth flow path thereby increasing output (cfm) while decreasing noise/sound. Accordingly, contrary to the volute housing 10 in which fluid/air flow between the tongue or cut-off 43 and the first zone 44 up to the transition zone T is confined radially against expansion by the generally parallel sidewall portions 71, 72, in the volute housing 210 fluid/air expansion continues radially in the direction of flow from the tongue/cut-off area 245 to and through the transition area or throat 250 and the discharge orifice 230. Furthermore, since the various radii Rr, Ri and the abrupt radius portion 244 are relatively smooth, particularly lacking in flat angularly related walls, such as 72 and 74/76 and 74/61, 62 of the volute housing 10, smoother air flow under continuous expansion at minimum noise levels is characteristically achieved by the volute housing 210 of this embodiment of the invention.

Another novel volute housing for a centrifugal fan blower or the like is illustrated in FIGS. 24 through 27 of the drawings and is generally designated by the reference numeral 310.

The volute housing 310 includes a housing body defined by housing parts 311, 312 and 313. The housing parts 311, 313 define sidewalls of the housing 310, while the housing part 312 defines a central body portion or volute peripheral wall of the volute housing 310. The sidewalls 311, 313 are formed from polymeric/copolymeric plastic material, while the central body portion or part 312 is preferably formed from synthetic polymeric/copolymeric plastic material, but also can be formed from metal. The housing parts 311, 312 and 312, 313 are joined to each other along generally parallel radial planes R311, R313, respectively (FIG. 24), through respective interlocked edges 314, 315 and 316, 317, respectively.

The edges 314, 315 and 316, 317 carry pairs of fasteners 320 defined by female fasteners 321 carried by the edges 315, 316 and male fasteners 322 carried by the edges 314, 317. The fasteners 321, 322 are identical to the fasteners 16, 17 (FIG. 7) of the volute housing 10 and 221, 222 of the volute housing 210 (FIG. 17), and the description of the latter two are applicable to the former. Thus, in order to assemble the housing parts 311, 312 and 313 into the volute housing 310 of the configuration shown at the right in FIG. 24, the parts or body portions 311 through 313 are aligned with each other and are snap-secured together through the interlocking of the male fasteners or tongues 322 with and in the female fasteners 321.

The central part or central body portion 312 of the volute housing 310 includes a volute peripheral wall 325 which is curved for an appreciable portion of its periphery and merges with generally parallel wall portions 326, 327 defining a discharge opening 330. Each of the walls 326, 327 includes a flange 331 normal thereto having openings 332 formed therein. The openings 332 are adapted to receive fasteners for securing the volute housing 310 to a condensation pan or tray of a heat pump.

The volute peripheral wall 325 extends generally from a volute tongue or cut-off 345 which is located generally at a first zone 346 of minimal radial dimension (See FIGS. 24 and 25) to a second zone or volute throat 350 (See FIGS. 24 and 25) which are approximately but not quite circumferentially spaced 360° from each other, and somewhat closer to and preferably 350° from each other. The direction of fluid/air flow is counterclockwise, as viewed in FIG. 25, and in the latter figure, the sidewall 313 is clearly illustrated progressively increasing in radial size in the direction of fluid travel from the first zone 346 or tongue 345 of minimum radial dimension to the second zone or throat 350 which is adjacent to but not precisely at the maximum radial dimension established by the overall cross-sectional area of the discharge orifice 330.

Since the sidewalls 311, 313 are identical, the following description of the sidewall 313 is applicable to the sidewall 311. The sidewall 313 includes a peripheral wall portion 319 (FIG. 26) which includes the edge 317, which abuts the edge 316 of the volute peripheral wall 325 and merges with a radially outermost sidewall portion 341 defined by a radius R'r. The radially outermost sidewall portion 341 blends or merges with an innermost sidewall portion 342 and the latter terminates in a terminal edge or edge portion 359 which defines a circular air inlet 360. The innermost sidewall portion 342 is in axial inwardly diverging relationship relative to the peripheral wall portion 319, and is also of a relatively shallow inwardly opening concave configuration having a curvature defined by a radius R'i.

Figure 26:
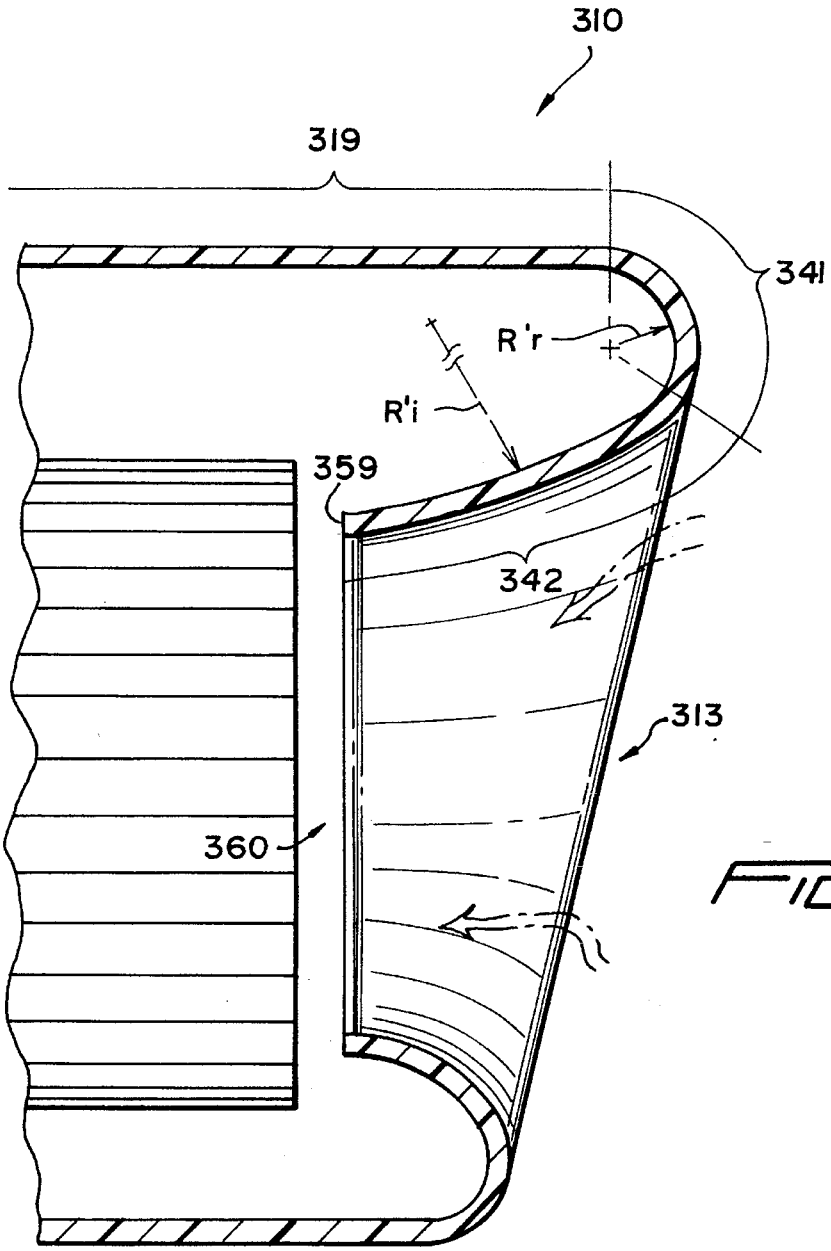
FIG. 26 is an axial cross-sectional view taken generally along line 26—26 of FIG. 25, and illustrates the specific configuration of innermost and outermost sidewall portions of the sidewall and the absence of an associated medial wall portion.
Figure 27:
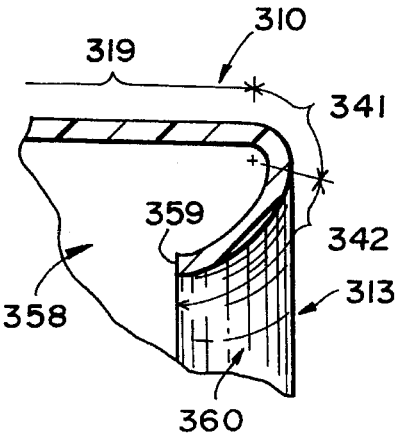
FIG. 27 is a fragmentary cross-sectional view taken generally along line 27—27 of FIG. 25, and illustrates details of the cross-section of the sidewall adjacent the tongue.

As will be seen by comparing FIG. 26 with FIG. 27, the illustration in FIG. 26 is a cross-section of the sidewall 313 adjacent the throat 350 and is illustrative of the radius R'r approaching its maximum size or curvature prior to air exiting the throat 350 and the discharge opening 330. Further upstream the radially outermost sidewall portion 341 is progressively narrower (See FIG. 27) and generally approaches its narrowest radial cross-section in the area of the tongue 345. During this same progressive lessening of the radius R'r from the throat 350 toward and to the throat 345, the innermost sidewall portion 342 also lessens or reduces in axial length, as is readily apparent from comparing FIGS. 26 and 27. Thus, though the radius R'r subtends an angle of approximately generally 120°–140° along the sidewall 313 between the tongue 345 and the throat 350, the radius R'r progressively changes. In effect the radially outermost sidewall portion 341 and the radially innermost sidewall portion 342 have a minimum radius and axial length, respectively, at the tongue 345 and/or first zone 346 of the volute chamber 358 while having a maximum radius and axial length respectively adjacent the throat or second zone 350. Furthermore, the minimum radius and axial length each progressively increases from the first zone 346 or throat 345 to the second zone 350, and the overall arcuate distance between these two first and second zones, 345 and 350, respectively, approaches 360° but preferably is generally 350°. Thus, the sidewalls 311, 313 collectively define with the central body 312 the volute chamber 358 which progressively converges from the throat 345 to the discharge opening 330, as is clearly illustrated and exemplified in FIGS. 24 and 25. Due to the latter construction, air drawn axially into circular axially aligned circular openings 360 of each of the side walls 311, 313 is drawn extremely smoothly into the volute chamber 358 in the absence of excessive and erratic eddy currents and turbulence and similarly expands from the tongue 345 progressively toward and outwardly of the throat 350 in a very smooth flow path thereby increasing output (cfm) while decreasing noise/sound. It should be particularly noted that the sidewalls 311, 313 lack the abrupt radius portion 244 and the essentially radially inwardly "stepped" portion 243 of the sidewalls 211, 213 (See FIG. 21). Thus, while the sidewalls 211, 213 provide a relatively smooth transition for air flowing through the volute chamber 258, the eddy currents in the volute chamber 358 are reduced further and, thus, the fluid/air expansion continues radially in the direction of flow from the tongue/cut-off area 345 to and through the transition area or throat 350 and the discharge orifice 330 in an extremely smooth, efficient and silent manner. Obviously, much of the latter is due to the fact that the radius R'i is extremely large thereby creating a very shallow inwardly opening concave configuration to the innermost sidewall portion 342 which in turn creates smoother air flow under continuous expansion at minimum noise levels.

While specific preferred forms of volute housings have been disclosed herein, modifications thereof are considered to be within the scope of the present invention. For example, while the volute housing 10 and specifically the housing parts 11, 12 are preferably made from synthetic polymeric/copolymeric plastic material, each of the housing parts 11, 12 can be fabricated from sheet metal. The same is true of the volute housing 110 and the housing parts 111, 112 thereof. In the case of the volute housing 210, any one or all of the housing parts 211, 212 and 213 can be made from sheet metal or from molded synthetic polymeric/copolymeric plastic material. For example, the housing part 212 can be made of synthetic plastic material, while the housing parts 211, 213 can be made of metal, or vice versa. Moreover, in keeping with this embodiment of the invention, the housing part 212 can be changed in axial length to alter the overall axial length of the volute housing 210 by either lengthening or shortening the same which will alter (increase or decrease) the performance characteristics in the sense of the cfm being increased or decreased by a corresponding change in the axial length of the impeller/fan (not shown). Obviously, the volute housing 310 can correspond in construction to the details just described with respect to the volute housing 210.

If one wishes to reduce the sound of any of the volute housings beyond that afforded by the specific construction of the sidewalls thereof, various approaches are also considered within the scope of the present invention. For example, any one of the sidewalls or the central volute body or body portion, when constructed of metal, can be overcoated on its interior and/or exterior with synthetic polymeric/copolymeric plastic material. Even an all-plastic volute housing can be interiorly or exteriorly overcoated with synthetic plastic material. For example, sound dampening characteristics can be increased by coating metal and/or plastic sidewalls and/or the central body part with polyurethane foam, either by spraying or dip-coating.

Although a preferred embodiment of the invention has been specifically illustrated and described herein, it is to be understood that minor variations may be made in the apparatus without departing from the spirit and scope of the invention as defined in the appended claims.

I claim:

1. A volute housing for a centrifugal fan, blower or the like comprising a housing body defined by opposite space sidewalls; each of said sidewalls being defined by a radially innermost sidewall portion and a radially outermost sidewall portion; each radial innermost sidewall portion being of a generally concavo-convex cross-sectional configuration having a terminal edge defining a generally circular fluid inlet opening, each radially innermost sidewall portion also opens generally toward an interior volute chamber of said housing body, said radially outermost sidewall portion being of a generally concavely curved configuration extending generally 180° and opening generally inwardly toward said volute chamber, an outer volute peripheral wall between said radially outermost sidewall portions, each radial outermost sidewall portion and each radial innermost sidewall portion having a minimum radius and an axial length respectively at a first zone adjacent a tongue of said volute chamber, each radially outermost sidewall portion and each radially innermost sidewall portion having a maximum radius and axial length respectively at a second zone adjacent a throat of said volute chamber, said minimum radius and axial length each substantially constantly progressively increasing from said first zone to said second zone, and the arcuate distance between said first and second zones approaching generally 360°.

2. The volute housing as defined in claim 1 including an outer volute peripheral wall bridging between said radially outermost sidewall portions of said sidewalls.

3. The volute housing as defined in claim 1 wherein said radially outermost sidewall portion extends less than 180°.

4. The volute housing as defined in claim 1 wherein said radially outermost sidewall portion extends substantially less than 180°.

5. The volute housing as defined in claim 1 wherein said radially outermost sidewall portions each extend generally in the range of between 120° and 140°.

6. The volute housing as defined in claim 1 wherein said sidewalls are constructed from sheet metal.

7. The volute housing as defined in claim 1 wherein said sidewalls are constructed from synthetic polymeric/copolymeric plastic material.

8. The volute housing as defined in claim 1 including a central housing body between said opposite spaced sidewalls, and one of said opposite spaced sidewalls and said central housing body being constructed from sheet metal.

9. The volute housing as defined in claim 1 including a central housing body between said opposite spaced sidewalls, and one of said opposite spaced sidewalls and said central housing body being constructed from synthetic polymeric/copolymeric plastic material.

10. A volute housing for a centrifugal fan, blower or the like comprising a housing body defined by opposite space sidewalls; each of said sidewalls being defined by a radially innermost sidewall portion and a radially outermost sidewall portion; each radial innermost sidewall portion being of a generally shallow concavo-convex cross-sectional configuration having a terminal edge defining a generally circular fluid inlet opening, each radially innermost sidewall portion also opens generally toward an interior volute chamber of said housing body, said radially outermost sidewall portion being of a generally concavely curved configuration extending generally in the range between 120° and 180°, each radial outermost sidewall portion and each radial innermost sidewall portion having a minimum radius and an axial length respectively at a first zone adjacent a tongue of said volute chamber, each radially outermost sidewall portion and each radially innermost sidewall portion having a maximum radius and axial length respectively at a second zone adjacent a throat of said volute chamber said minimum radius and axial length each substantially constantly progressively increasing from said first zone to said second zone, and the arcuate distance between said first and second zones approaching generally 360°.

11. A volute housing for a centrifugal fan, blower or the like comprising a housing body defined by opposite space sidewalls; each of said sidewalls being defined by a radially innermost sidewall portion and a radially outermost sidewall portion; each radial innermost sidewall portion being of a generally shallow concavoconvex cross-sectional configuration having a terminal edge defining a generally circular fluid inlet opening, each radially innermost sidewall portion also opens generally toward an interior volute chamber of said housing body, said radially outermost sidewall portion being of a generally concavely curved configuration extending generally in the range between 120° and 140°, each radial outermost sidewall portion and each radial innermost sidewall portion having a minimum radius and an axial length respectively at a first zone adjacent a tongue of said volute chamber, each radially outermost sidewall portion and each radially innermost sidewall portion having a maximum radius and axial length respectively at a second zone adjacent a throat of said volute chamber, said minimum radius and axial length each substantially constantly progressive; increasing from said first zone to said second zone, and the arcuate distance between said first and second zones approaching generally 360°.

12. A volute housing for a centrifugal fan, blower or the like comprising a housing body defined by opposite space sidewalls; at least one of said sidewalls being defined by a radially innermost sidewall portion and a radially outermost sidewall portion; such at least one radial innermost sidewall portion having a terminal edge defining a generally circular fluid inlet opening, each radially innermost sidewall portion also opens generally toward an interior volute chamber of said housing body, said radially outermost sidewall portion being of a generally concavely curved configuration extending generally in the range between 120° and 180°, each radial outermost sidewall portion and each radial innermost sidewall portion having a minimum radius and an axial length respectively at a first zone adjacent a tongue of said volute chamber, each radially outermost sidewall portion and each radially innermost sidewall portion having a maximum radius and axial length respectively at a second zone adjacent a throat of said volute chamber said minimum radius and axial length each substantially constantly progressively increasing from said first zone to said second zone, and the arcuate distance between said first and second zones approaching generally 360°.

13. The volute housing as defined in claim 12 wherein air is adapted to flow within said volute chamber in a direction generally from said tongue toward said throat, and said throat being disposed in a zone at which said radially outermost sidewall portion diverges both in the same direction and opposite the direction of air flow within said volute chamber.

14. The volute housing as defined in claim 12 wherein a portion of said radially outermost sidewall portion diverging in the direction opposite to air flow within said volute chamber projects beyond said tongue.

* * * * *